US008160873B2

(12) United States Patent
Kato et al.

(10) Patent No.: US 8,160,873 B2
(45) Date of Patent: Apr. 17, 2012

(54) METHOD AND APPARATUS FOR NOISE SUPPRESSION

(75) Inventors: Masanori Kato, Tokyo (JP); Akihiko Sugiyama, Tokyo (JP)

(73) Assignee: NEC Corporation, Tokyo (JP)

( * ) Notice: Subject to any disclaimer, the term of this patent is extended or adjusted under 35 U.S.C. 154(b) by 1501 days.

(21) Appl. No.: 11/442,663

(22) Filed: May 30, 2006

(65) Prior Publication Data

US 2006/0271362 A1 Nov. 30, 2006

(30) Foreign Application Priority Data

May 31, 2005 (JP) ..... 2005-158447

(51) Int. Cl.
*G10L 21/00* (2006.01)
*G10L 11/00* (2006.01)

(52) U.S. Cl. ..... 704/226; 704/201

(58) Field of Classification Search ..... 704/201, 704/226

See application file for complete search history.

(56) References Cited

U.S. PATENT DOCUMENTS 5,012,519 A * 4/1991 Adlersberg et al. ..... 704/226
2002/0156623 A1 10/2002 Yoshida
2004/0049383 A1 3/2004 Kato et al.
2005/0152563 A1 7/2005 Amada et al.

FOREIGN PATENT DOCUMENTS

JP 2002-73066 A 3/2002
JP 2002-204175 A 7/2002
JP 2003-233186 A 8/2003
JP 2005-19555 A 7/2005

* cited by examiner

*Primary Examiner* — Justin Rider
(74) *Attorney, Agent, or Firm* — Foley & Lardner LLP

(57) ABSTRACT

In a noise suppression apparatus for suppressing noise contained in a speech signal, the speech signal is converted to a first vector of spectral speech components and a second vector of spectral speech components identical to the first vector. A vector of noise suppression coefficients is determined based on the first vector spectral speech components. A vector of estimated noise components is determined based on the first vector spectral speech components, and a speech section correction factor and a nonspeech section correction factor are calculated from the estimated noise components and the first-vector spectral speech components to produce a combined correction factor. The noise suppression coefficients are weighted by the combined correction factor to produce a vector of post-suppression coefficients. The second vector spectral speech components are weighted by the post-suppression coefficients to produce a vector of enhanced speech components.

33 Claims, 25 Drawing Sheets

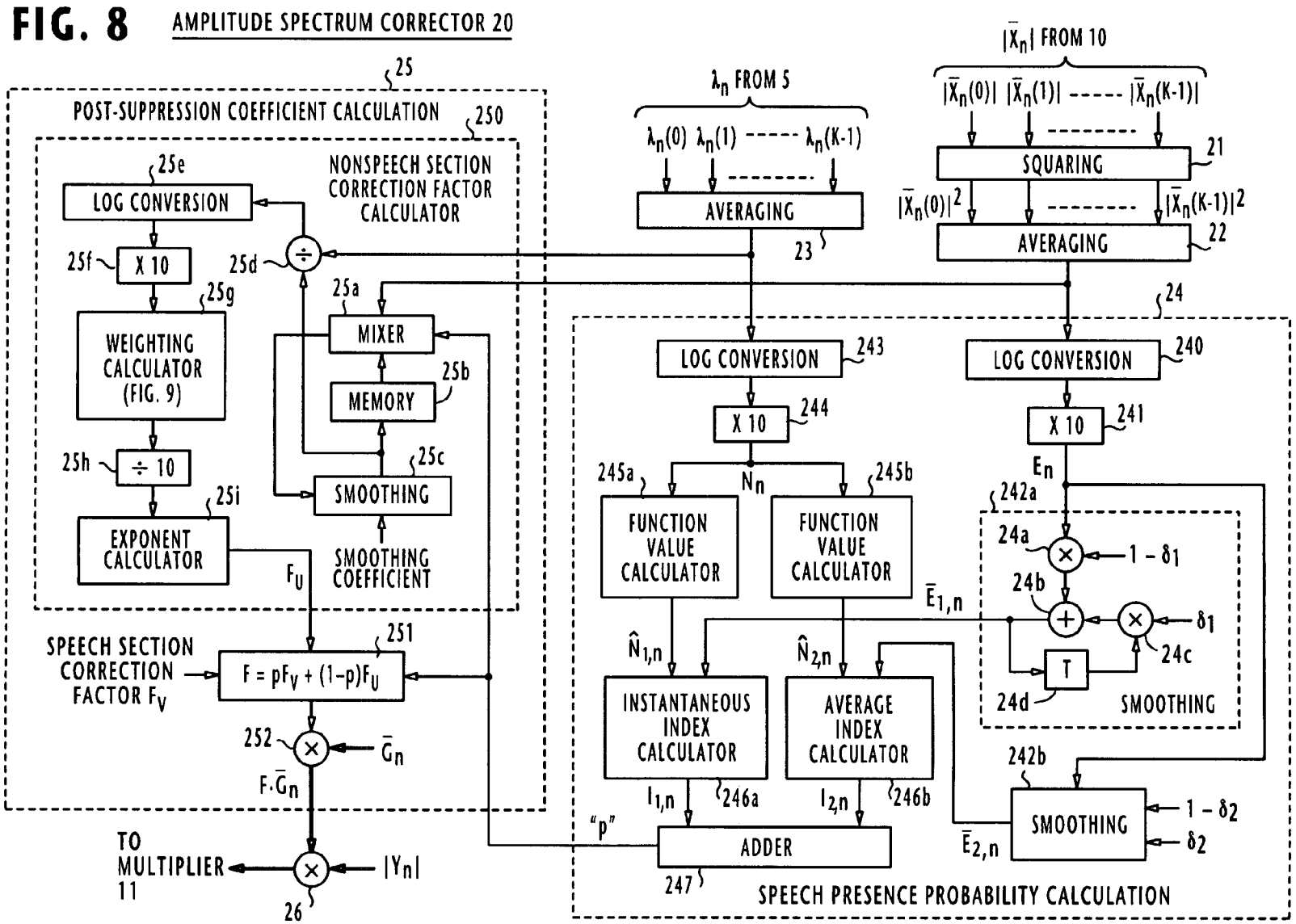
FIG. 8 AMPLITUDE SPECTRUM CORRECTOR 20
25
POST-SUPPRESSION COEFFICIENT CALCULATION
250
NONSPEECH SECTION CORRECTION FACTOR CALCULATOR
LOG CONVERSION
25e
X 10
25f
WEIGHTING CALCULATOR (FIG. 9)
25g
÷ 10
25h
EXPONENT CALCULATOR
25i
25d
MIXER
25a
MEMORY
25b
SMOOTHING
25c
SMOOTHING COEFFICIENT
$F_U$
$F = pF_V + (1-p)F_U$
251
SPEECH SECTION CORRECTION FACTOR $F_V$
$\bar{G}_n$
252
$F \cdot \bar{G}_n$
$|Y_n|$
26
TO MULTIPLIER 11
$|\bar{X}_n|$ FROM 10
$|\bar{X}_n(0)|$ $|\bar{X}_n(1)|$ ----- $|\bar{X}_n(K-1)|$
SQUARING
21
$|\bar{X}_n(0)|^2$ $|\bar{X}_n(K-1)|^2$
AVERAGING
22
$\lambda_n$ FROM 5
$\lambda_n(0)$ $\lambda_n(1)$ ----- $\lambda_n(K-1)$
AVERAGING
23
24
LOG CONVERSION
240
X 10
241
$E_n$
242a
24a
$1-\delta_1$
24b
24c
$\delta_1$
T
24d
SMOOTHING
242b
SMOOTHING
$1-\delta_2$
$\delta_2$
$\bar{E}_{2,n}$
$\bar{E}_{1,n}$
LOG CONVERSION
243
X 10
244
$N_n$
245a
FUNCTION VALUE CALCULATOR
245b
FUNCTION VALUE CALCULATOR
$\hat{N}_{1,n}$
$\hat{N}_{2,n}$
INSTANTANEOUS INDEX CALCULATOR
246a
AVERAGE INDEX CALCULATOR
246b
$I_{1,n}$
$I_{2,n}$
ADDER
247
"p"
SPEECH PRESENCE PROBABILITY CALCULATION

AMPLITUDE SPECTRUM CORRECTOR 20

AMPLITUDE SPECTRUM CORRECTOR 20

AMPLITUDE SPECTRUM CORRECTOR 20

AMPLITUDE SPECTRUM CORRECTOR 20

A-PRIORI SNR CALCULATOR 7A

NOISE SUPPRESSION COEFFICIENT CORRECTOR 9A

A-PRIORI SNR CALCULATOR 7B

AMPLITUDE SPECTRUM CORRECTOR 20A

SPEECH PRESENCE PROBABILITY CALCULATOR 16

AMPLITUDE SPECTRUM CORRECTOR 20B

SPEECH PRESENCE PROBABILITY CALCULATOR 16A

METHOD AND APPARATUS FOR NOISE SUPPRESSION

BACKGROUND OF THE INVENTION

1. Field of the Invention

The present invention relates to a method and apparatus for suppressing noise in a noisy speech signal.

2. Description of the Related Art

Noise suppression is a technique that involves estimating the power spectrum of a noise component introduced to an input noisy speech signal using a frequency-domain signal and subtracting the estimated power spectrum from the noisy speech signal. By continuously estimating the noise component, the noise suppression technique is also useful for suppressing nonstationary noise. The noise suppressor of this type is described in Japanese Patent Publication 2002-204175. FIG. 1 illustrates the noise suppressor of this patent publication. As illustrated, samples of a noisy speech signal are supplied to a frame decomposition and windowing circuit 1, which divides the signal into frames with K/2 samples where K represents an even number. The frames are multiplied by a window function w(t). A signal $\bar{y}_n(t)=w(t)y_n(t)$ is produced by windowing the $n^{th}$-frame of the noisy speech signal $y_n(t)$ (t=0, 1, . . . , (K/2)−1). For real-numbers, symmetrical window functions are used. The window function is designed so that, when the noise suppression coefficient is 1, the input and output signals coincide with each other (i.e., w(t)+w(t+K/2)=1). If two consecutive frames are windowed as such, the well-known Hanning window w(t) is used:

$$w(t)=\begin{cases}0.5+0.5\cos\left(\dfrac{\pi(t-K/2)}{K/2}\right), & 0\le t<K\\ 0, & \text{otherwise}\end{cases}$$

The windowed speech frame $\bar{y}_n(t)$ is supplied to a Fourier Transform converter 2 where the speech frame is converted to a vector of K frequency spectral speech components $Y_n=(Y_n(0), Y_n(1), \ldots, Y_n(K-1))$. This vector of spectral speech components is separated into a vector of K phase components $\arg Y_n=(\arg Y_n(0), \arg Y_n(1), \ldots, \arg Y_n(K-1))$ and a vector of K amplitude components $|Y_n|=(|Y_n(0)|, |Y_n(1)|, \ldots, |Y_n(K-1)|)$, the former being supplied to a multiplier 10 and the latter being fed to a squaring circuit 3 where the K amplitude spectral speech components are mutually squared in K multipliers $\mathbf{3}_0$~$\mathbf{3}_{K-1}$. The squared values $|Y_n|^2=(|Y_n(0)|^2, |Y_n(1)|^2, \ldots, |Y_n(K-1)|^2)$ represents the power spectrum of a noisy speech. The outputs of the squaring circuit 3 are supplied to a power spectrum weighting circuit 4 (FIG. 2) where weighting is performed on the K frequency spectral speech components.

In FIG. 2, this power spectrum weighting is achieved first by calculating spectral signal-to-noise ratios using an array of dividers $\mathbf{41}_0$~$\mathbf{41}_{K-1}$ to divide the K speech power components $|Y_n|^2$ by a vector of K noise power spectral components $\lambda_{n-1}$ which were estimated during a previous frame in a noise estimation circuit 5 and stored in a memory 42, producing a vector of SNR values $\hat{\gamma}_n=|Y_n|^2/\lambda_{n-1}$. These SNR values are then subjected to a nonlinear processing through a vector of nonlinear weighting circuits $\mathbf{43}_0$~$\mathbf{43}_{K-1}$ each having a nonlinear function of the form:

$$f_2=\begin{cases}1, & f_1\le a\\ \dfrac{f_1-b}{a-b}, & a<f_1<b\\ 0, & b<f_1\end{cases}$$

where, "a" and "b" are arbitrary real numbers. Each nonlinear weighting circuit 43 produces a weight value that equals 0 when the input SNR value is larger than "b" and 1 when the SNR is smaller than "a" and assumes a value anywhere between 0 and 1 that is inversely variable in proportion to the SNR value. Finally, the input K spectral speech power components $|Y_n|^2$ are multiplied respectively by the K weighting factors using a spectral multiplier 44 to produce a vector of weighted power spectral speech components. This vector of weighted power spectral speech components is supplied to a noise estimation circuit 5 (FIG. 3) to which the spectral power speech components $|Y_n|^2$ are also supplied from the squaring circuit 3. The nonlinear weighting by the circuits 43 is to reduce the adverse effect of the voiced components of the noisy speech power spectrum on estimating its noise components.

In FIG. 3, the K weighted spectral power speech components from the power spectrum weighting circuit 4 and the non-weighted K spectral power speech components from the squaring circuit 3 are respectively processed through noise calculators $\mathbf{50}_0$~$\mathbf{50}_{K-1}$. In each noise calculator 50, the weighted component is passed through a gate 54 of a register update decision circuit 51 to a shift register 55 when the gate 54 is turned ON in response to a "1" from OR gate 511. This results in the shift register 55 being updated with a new spectral component. This shift-register update occurs when the initial period detector 512 supplies a "1" to OR gate 511 during the initial start-up time of the noise suppressor, or when the magnitude of the non-weighted power spectral components is low, indicating that it is a speech absence signal or a voiced low-level signal. In the latter case, the comparator 515 supplies a "1" to the OR gate 511 after comparison with a decision threshold that was stored in a memory 514 during the previous frame interval by a threshold calculator 513. A sample counter 59 increments its count value in response to a logical-1 output from the OR gate 511 to determine the number of weighed power spectral components stored in the shift register 55 during each frame interval. The counter is reset to zero when the count value becomes equal to the length of the shift register 55. The output of the counter 59 is compared in a minimum selector 57 with the length of the shift register 55. Minimum selector 57 selects the smaller of the two as a value M. The total sum of the M components $B_{n,0}(k), B_{n,1}(k), \ldots, B_{n,M-1}(k)$, which are stored in the shift register 55 during a frame "n" is calculated by an adder 56 and divided by the value M in a division circuit 58 to produce an output $\lambda_n(k)$ as follows:

$$\lambda_n(k)=\frac{1}{M}\sum_{m=0}^{M-1}B_{n,m}(k)$$

Since the output of sample counter 59 increases monotonically from the instant the noise suppressor is started, the division operation proceeds using initially the sample counter output. As the process continues, the sample counter 59 increases its output and eventually becomes higher than the register length, whereupon the division operation proceeds using the register length as a divisor. When the register length is used, the division output $\lambda_n$ represents an average power of the total sum of the weighted power spectral speech components. The quotient value $\lambda_n$ of the division operation is supplied to the threshold calculator 513, which multiplies the input value by a predetermined number or by a high-order polynomial or non-linear function, to produce a decision threshold to be used in the comparator 515 during the next frame. The quotient $\lambda_n$ is the estimated noise that is supplied as a feedback signal to the power spectrum weighting circuit 4 and stored in its memory 42 to update the weighted power spectral noise components for the next frame.

Returning to FIG. 1, in an a-posteriori SNR (signal-to-noise ratio) calculator 6, the speech power spectral components $|Y_n|^2$ of the squaring circuit 3 are respectively divided by the estimated noise power spectral components $\lambda_n$ of the noise estimation circuit 5 to produce a vector of a-posteriori SNR values $\gamma_n$, which are in turn supplied to an a-priori (a priori) SNR estimation circuit 7 (FIG. 4).

In FIG. 4, the a-posteriori (a posteriori) SNR values $\gamma_n$ are each summed with "−1" in adders 70, producing a vector of $\{\gamma_n(0)-1\}, \{\gamma_n(1)-1\}, \ldots, \{\gamma_n(k-1)-1\}$, which are restricted in range in a range restriction circuit 71 using maximum selectors $\mathbf{71}_0$~$\mathbf{71}_{K-1}$. The maximum selectors compare their input with a value "zero" and select the greater of the two according to the relation P[x]=x, if x>0 and 0 if x≦0 and deliver outputs $P[\gamma_n(k)-1]$ to multiply-and-add circuits $\mathbf{77}_0$~$\mathbf{77}_{K-1}$. The a-posteriori SNR values $\gamma_n(k)$ from a-posteriori SNR calculator 6 are also stored in a memory 72 for a frame interval and then supplied to a multiplier 75 as a vector of previous-frame a-posteriori SNR values $\gamma_{n-1}(0)$~$\gamma_{n-1}(K-1)$. These previous frame a-posteriori SNR values are multiplied by a vector of squared corrected noise suppression coefficients of previous frame $\overline{G}_{n-1}^2$ that is supplied from a squaring circuit 74 to produce and supply a vector of values $\gamma_{n-1}\overline{G}_{n-1}^2$ to the multiply-and-add circuits $\mathbf{77}_0$~$\mathbf{77}_{K-1}$ as a vector of estimated SNR values of previous frame. To generate $\overline{G}_{n-1}^2$ a vector of corrected noise suppression coefficients $\overline{G}_n$ is received from a noise suppression coefficients corrector 9 and stored in a memory 73 for a frame interval and squared in a squaring circuit 74 to produce $\overline{G}_{n-1}^2$. In each multiply-and-add circuit 77, the input signal $P[\gamma_{n-1}(k)-1]$ from the corresponding maximum selector 71 is multiplied in a multiplier 771 by a factor $(1-\alpha)$ (where $\alpha$ is a weight value), and the previous-frame estimated SNR values $\gamma_{n-1}(k)\overline{G}_{n-1}^2$ from the multiplication circuit 75 are multiplied in a multiplier 772 by the weight value $\alpha$ and summed with the output of multiplier 771 to produce an estimated a-priori SNR value in $\hat{\xi}_n=\alpha\gamma_{n-1}\overline{G}_{n-1}^2+(1-\alpha)P[\gamma_n-1]$, where $\overline{G}_{-1}^2\gamma_{-1}=1$. The estimated a-priori SNR values $\hat{\xi}_n(0)$~$\hat{\xi}_n(K-1)$ are supplied to a noise suppression coefficients calculator 8 (FIG. 5) and noise suppression coefficients corrector 9 (FIG. 6).

In FIG. 5, in addition to the estimated a-priori SNR vector $\hat{\xi}_n=(\hat{\xi}_n(0),\hat{\xi}_n(1), \ldots, \hat{\xi}_n(K-0))$ from the a-priori SNR calculator 7, the noise suppression coefficients calculator 8 receives the a-posteriori SNR vector $\gamma_n=\gamma_n(0)$~$\gamma_n(K-1)$ from the a-posteriori SNR calculator 6. Noise suppression coefficients calculator 8 includes a MMSE-STSA (Minimum Mean Sequence Error Short Time Spectral Amplitude) gain function value calculator 81 and a GLR (Generalized Likelihood Ratio) calculator 82. For each spectral component, the MMSE-STSA gain function calculator 81 uses the a-posteriori SNR values $\gamma_n$ and the a-priori SNR values $\hat{\xi}_n$ and a speech absence probability "q" to calculate an MMSE-STSA gain function $G_n$ as follows:

$$G_n = \frac{\sqrt{\pi}}{2}\frac{\sqrt{\nu_n}}{\gamma_n}\exp\left(-\frac{\nu_n}{2}\right)\left[(1+\nu_n)I_0\left(\frac{\nu_n}{2}\right)+\nu_n I_1\left(\frac{\nu_n}{2}\right)\right]$$

where, $I_0(z)$=Zero-order modified Bessel function, $I_1(z)$=First-order modified Bessel function, $\nu_n=(\eta_n\gamma_n)/(1+\eta_n)$, and $\eta_n=\hat{\xi}_n/(1-q)$.

Using the same values of a-posteriori and a-priori SNR and speech absence probability as those used in the calculator 81, the GLR calculator 82 calculates a vector of K generalized likelihood ratios $\Lambda_n$ as follows:

$$\Lambda_n = \frac{1-q}{q}\frac{\exp\nu_n}{1+\eta_n}$$

The gain function $G_n$ and the GLR value $\Lambda_n$ are used in a calculation circuit 83 to provide a noise suppression coefficients corrector 9 (FIG. 6) with a vector of noise suppression coefficients $\overline{G}_n$ given by:

$$\overline{G}_n = \frac{\Lambda_n}{\Lambda_n+1}G_n$$

In FIG. 6, the noise suppression coefficients $\overline{G}_n$ and the a-priori SNR values $\hat{\xi}_n$ are supplied to noise suppression coefficient correction circuits $\mathbf{91}_0$~$\mathbf{91}_{K-1}$. Each a-priori SNR value is compared in a comparator 911 with a threshold value to produce a control signal for a selector 912, through which the noise suppression coefficient is selectively coupled to a maximum selector 914 either via a multiplier 913 or a through-connection depending on the magnitude of the a-priori SNR value relative to the threshold value. When the a-priori SNR value is lower than the threshold value, the selector 912 is switched to the lower position, coupling the noise suppression coefficient to the multiplier 913 where it is scaled by a correction value. Otherwise, the selector 912 is switched to the upper position, coupling the noise suppression coefficient direct to the maximum selector 914. Maximum selector 914 compares the input signal with a lower limit value of correction and delivers the greater of the two to a multiplier 10.

Returning to FIG. 1, the multiplier 10 multiplies the corrected noise suppression coefficients $\overline{G}_n$ by the speech amplitude spectral components $|Y_n|$ supplied from the Fourier transform converter 2 to produce enhanced speech amplitude spectral components $|\overline{X}_n|=\overline{G}_n|Y_n|$. The latter is multiplied by the phase components arg $Y_n$ in a multiplier 11 to produce enhanced speech spectral components $\overline{X}_n=|\overline{X}_n|\arg Y_n$. Inverse Fourier transform is performed on the enhanced speech components in an inverse Fourier transform converter 12 to produce a speech frame containing a series of K time-domain components $\overline{x}_n(t)$, where t=0, 1, . . . , K−1. The K/2 time-domain components of successive two speech frames are combined in a frame synthesis 13 into enhanced speech samples of the form $\hat{x}_n(t)=\overline{x}_{n-1}(t+K/2)+\overline{x}_n(t)$.

However, the noise suppression coefficients of the prior art noise suppressor are calculated using the same algorithm without distinction between speech sections and noise sections. As a result, speech distortions can occur in speech sections, while suppression in noise sections is insufficient.

SUMMARY OF THE INVENTION

It is therefore an object of the present invention to provide a noise suppression method and apparatus capable of reducing the distortion of speech in speech sections, while at the same time providing sufficient noise suppression in noise sections.

According to a first aspect of the present invention, there is provided a method of suppressing noise in a speech signal, comprising converting the speech signal to a first vector of frequency spectral speech components and a second vector of frequency spectral speech components identical to the first vector frequency spectral speech components, determining a vector of noise suppression coefficients based on the first vector frequency spectral speech components, determining a speech-versus-noise relationship based on the first vector frequency spectral speech components, determining a vector of post-suppression coefficients based on the determined speech-versus-noise relationship, the first vector frequency spectral speech components and the noise suppression coefficients, and weighting the second vector frequency spectral speech components by the vector of post-suppression coefficients.

According to a second aspect, the present invention provides a method of suppressing noise in a speech signal, comprising converting the speech signal to a first vector of frequency spectral speech components and a second vector of frequency spectral speech components identical to the first vector frequency spectral speech components, determining a vector of noise suppression coefficients based on the first vector frequency spectral speech components, determining a speech-versus-noise relationship based on the first vector frequency spectral speech components, determining a plurality of lower limit values of noise suppression coefficients based on the determined speech-versus-noise relationship, comparing the noise suppression coefficients with the lower limit values of noise suppression coefficients and generating a vector of post-suppression coefficients depending on results of the comparison, and weighting the second vector of frequency spectral speech components by the vector of post-suppression coefficients.

According to a third aspect, the present invention provides a method of suppressing noise in a speech signal, comprising converting the speech signal to a first vector of frequency spectral speech components and a second vector of frequency spectral speech components identical to the first vector of frequency spectral speech components, determining a vector of noise suppression coefficients based on the first vector frequency spectral speech components, weighting the first vector frequency spectral speech components by the vector of noise suppression coefficients, determining a vector of correction factors based on the weighted first vector frequency spectral speech components and the vector of noise suppression coefficients, and weighting the vector of noise suppression coefficients by the vector of correction factors, and weighting the second vector of frequency spectral speech components by the weighted vector of noise suppression coefficients.

According to a fourth aspect, the present invention provides an apparatus for suppressing noise in a speech signal, comprising a converter that converts the speech signal to a first vector of frequency spectral speech components and a second vector of frequency spectral speech components identical to the first vector of frequency spectral speech components, a noise suppression coefficient calculator that determines a vector of noise suppression coefficients based on the first vector frequency spectral speech components, a speech-versus-noise relationship calculator that determines a speech-versus-noise relationship based on the first vector frequency spectral speech components, a post-suppression coefficient calculator that determines a vector of post-suppression coefficients based on the speech-versus-noise relationship, the first vector frequency spectral speech components and the vector of noise suppression coefficients, and a weighting circuit that weights the second vector of frequency spectral speech components by the vector of post-suppression coefficients.

According to a fifth aspect, the present invention provides an apparatus for suppressing noise in a speech signal, comprising a converter that converts the speech signal to a first vector of frequency spectral speech components and a second vector of frequency spectral speech components identical to the first vector of frequency spectral speech components, a noise suppression coefficient calculator that determines a vector of noise suppression coefficients based on the first vector of frequency spectral speech components, a speech-versus-noise relationship calculator that determines a speech-versus-noise relationship based on the first vector of frequency spectral speech components, a post-suppression coefficient calculator that determines a plurality of lower limit values of noise suppression coefficients based on the speech-versus-noise relationship, compares the vector of noise suppression coefficients with the lower limit values of noise suppression coefficients, and generates a vector of post-suppression coefficients depending on results of the comparison, and a weighting circuit that weights the second vector of frequency spectral speech components by the vector of post-suppression coefficients.

According to a sixth aspect, the present invention provides An apparatus for suppressing noise in a speech signal, comprising a converter that converts the speech signal to a first vector of frequency spectral speech components and a second vector of frequency spectral speech components identical to the first vector of frequency spectral speech components, a noise suppression coefficient calculator that determines a vector of noise suppression coefficients based on the first vector of frequency spectral speech components; a calculator that weights the first vector of frequency spectral components by the vector of noise suppression coefficients, a suppression coefficient corrector that calculates a vector of first section correction factors according to the weighted first vector frequency spectral components, combines the vector of the first section correction factors with a vector of second section correction factors to produce a vector of combined correction factors, and weights the vector of noise suppression coefficient by the vector of combined correction factors to produce a vector of suppression correction factors; and weighting circuit that weights the second vector of frequency spectral speech components by the vector of suppression correction factors.

BRIEF DESCRIPTION OF THE DRAWINGS

The present invention will be described in detail with reference to the following drawings, in which:

FIG. 8 is a block diagram of the amplitude spectrum corrector of FIG. 7;

DETAILED DESCRIPTION

Figure 1:
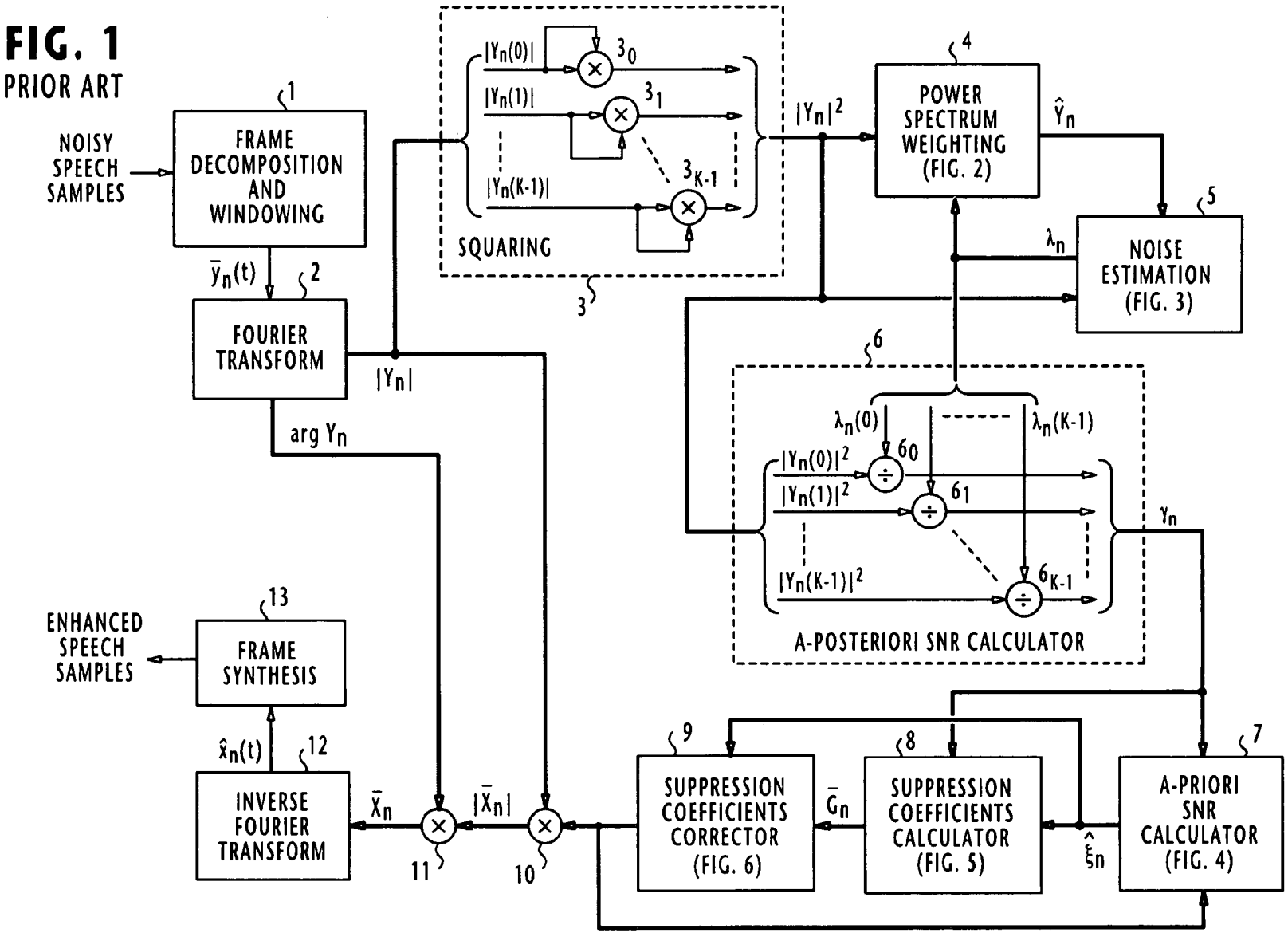
FIG. 1 PRIOR ART
FIG. 1 is a block diagram of a prior art noise suppressor for speech signals.
Figure 2:
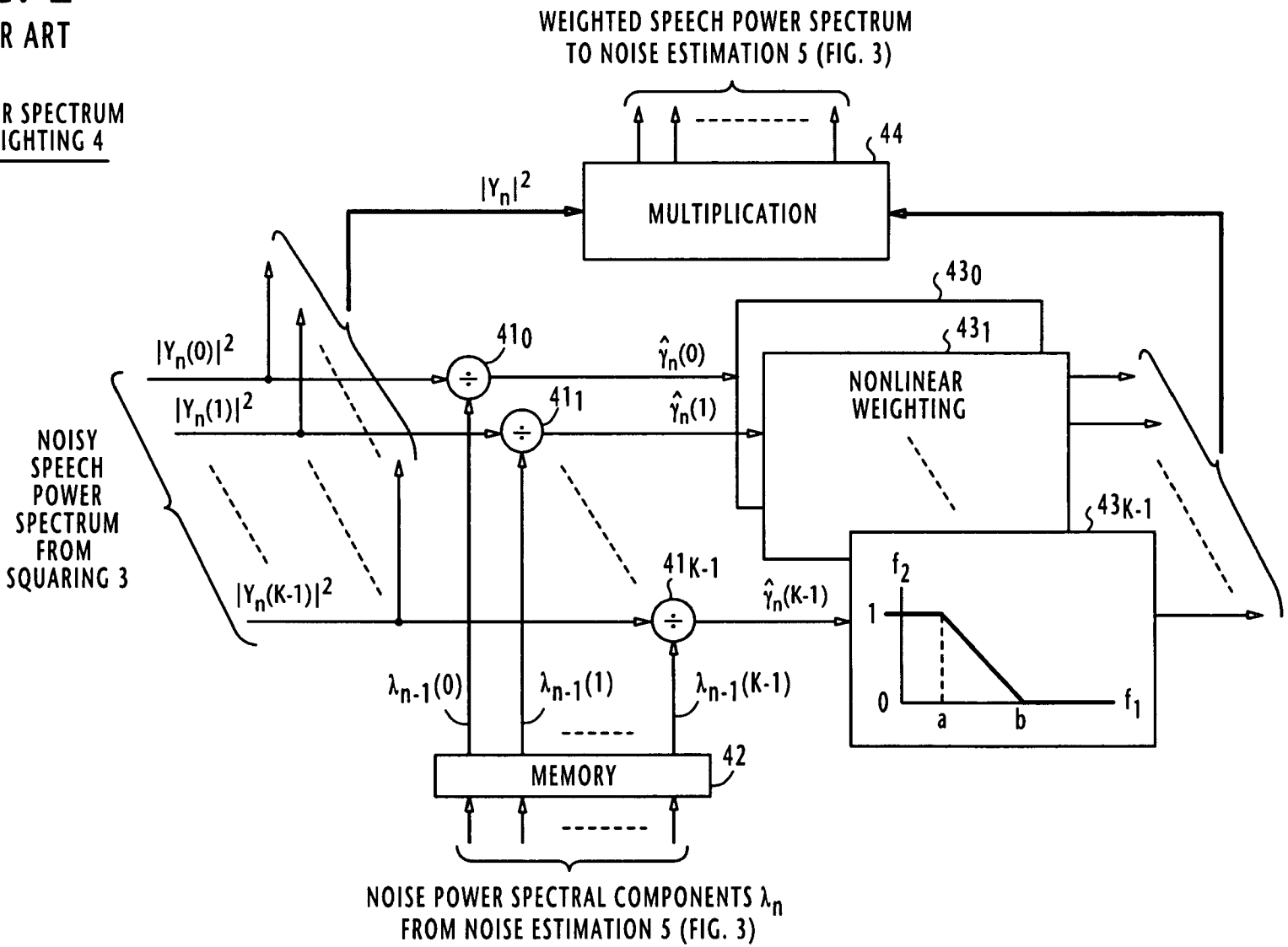
FIG. 2 PRIOR ART
FIG. 2 is a block diagram of the prior art power spectrum weighting circuit of FIG. 1.
Figure 3:
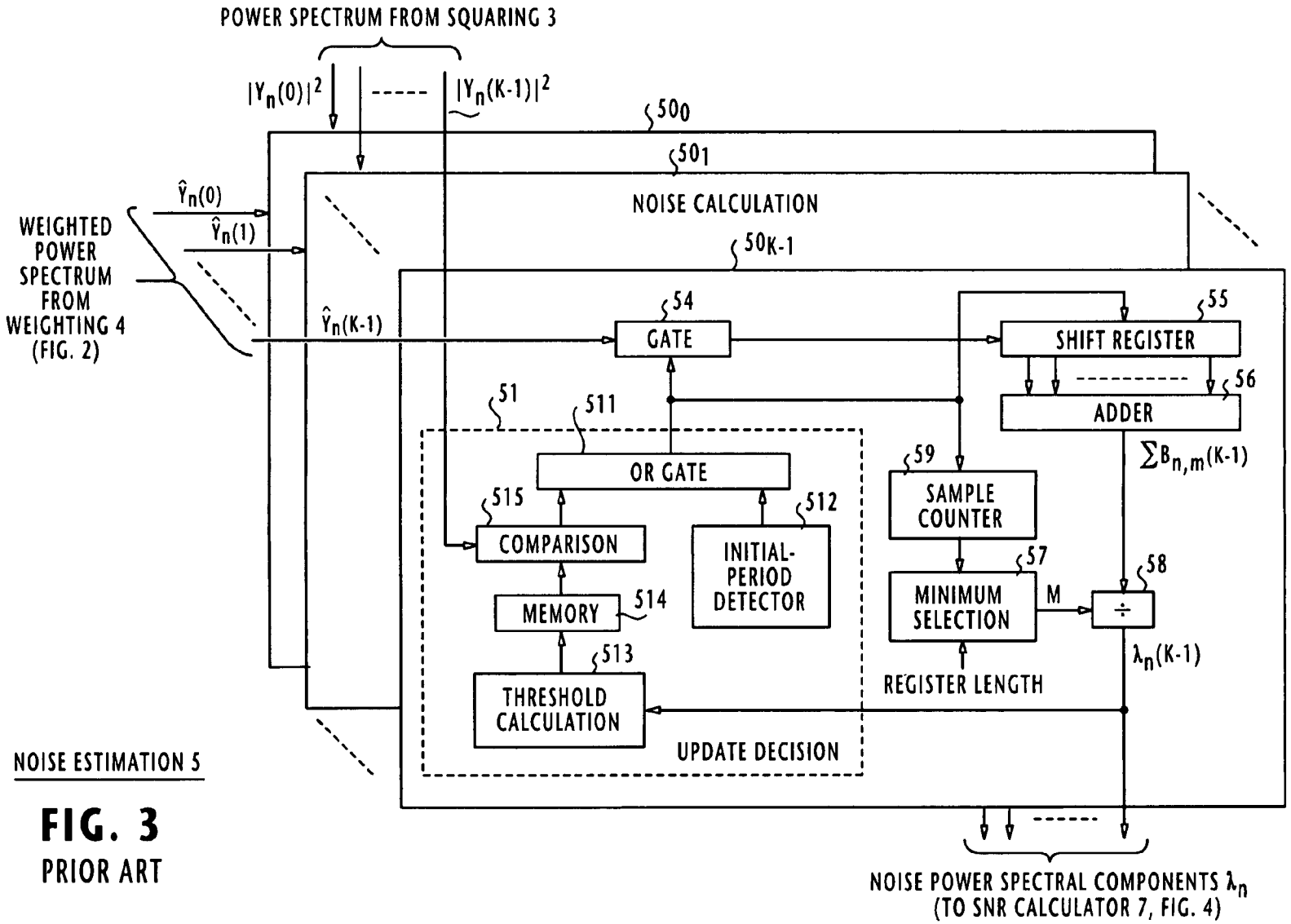
FIG. 3 PRIOR ART
FIG. 3 is a block diagram of the prior art noise estimation circuit of FIG. 1.
Figure 4:
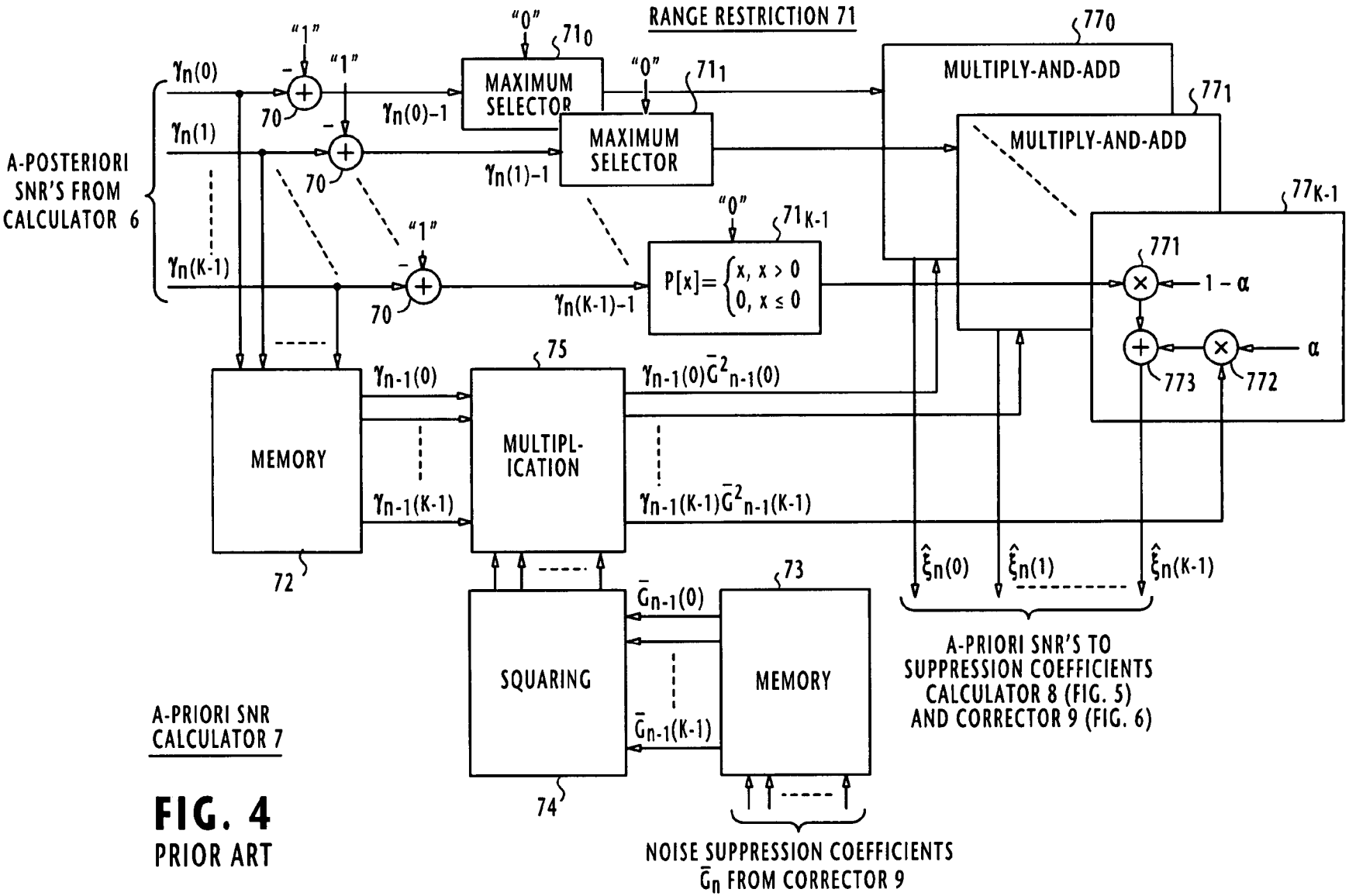
FIG. 4 PRIOR ART
FIG. 4 is a block diagram of the prior art a-priori SNR calculator of FIG. 1.
Figure 7:
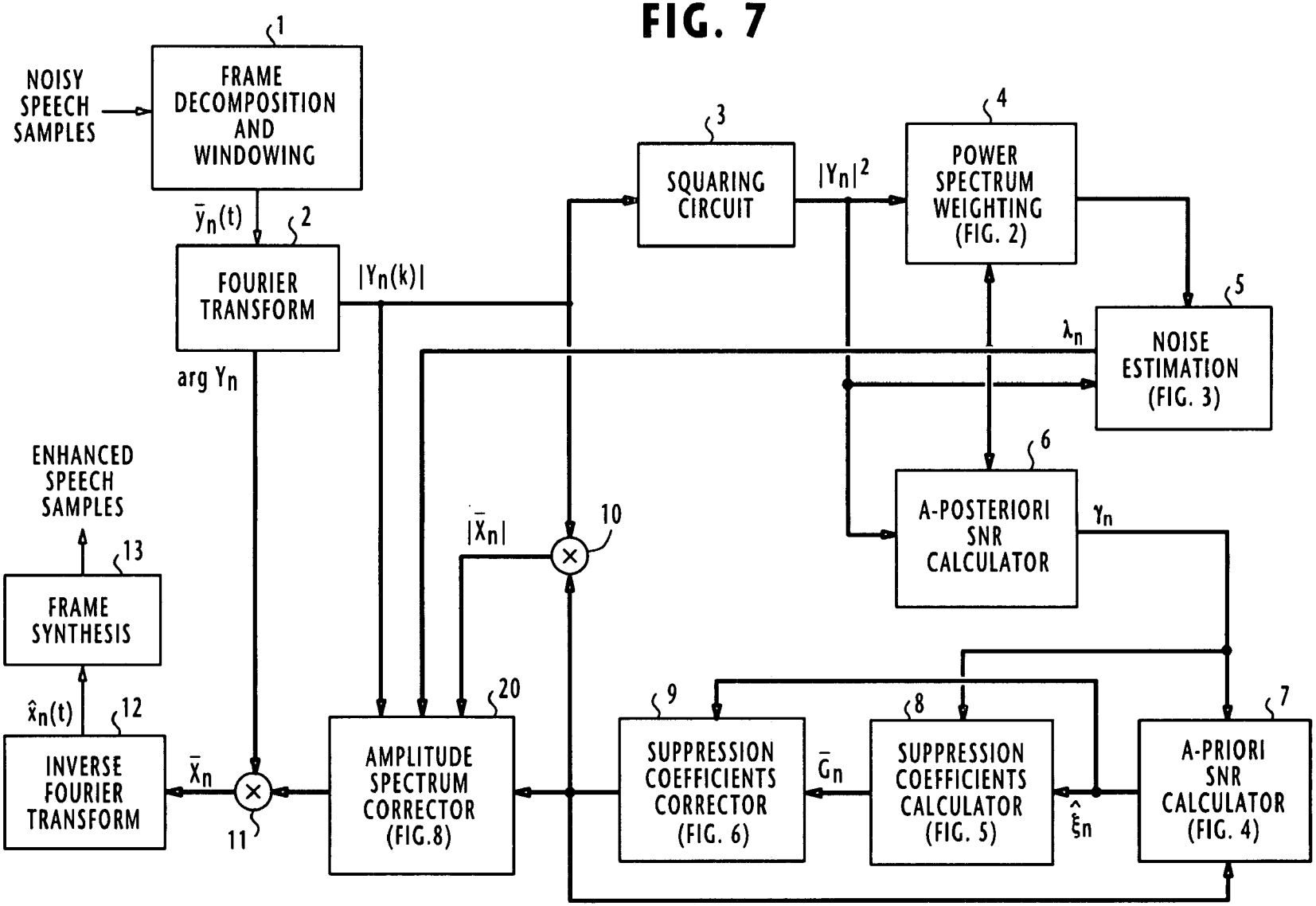
FIG. 7 is a block diagram of a noise suppressor for speech signals according to a first embodiment of the present invention.

Referring now to FIG. 7, there is shown a noise suppressor according to a first embodiment of the present invention. In FIG. 7, elements corresponding to those in FIG. 1 are marked with the same reference numerals and the description thereof is omitted. The noise suppressor of this invention differs from the prior art by the provision of a speech amplitude spectrum corrector 20. Amplitude spectrum corrector 20 is connected between the noise suppression coefficients corrector 9 and the multiplier 11 and receives the enhanced speech amplitude spectral components $|\overline{X}_n|$ from the multiplier 10 and the noise components $\lambda_n$ from the noise estimation circuit 5. These input components are the primary signals of the speech amplitude spectrum corrector 20 to generate a correction coefficient for speech sections and a correction coefficient for nonspeech sections to produce a combined coefficient F as described below. The combined coefficient F is used to modify the noise suppression coefficients $\overline{G}_n$ to produce a vector of post-suppression coefficients $F\cdot\overline{G}_n$. The speech amplitude components $|\gamma_n|$ are multiplied by the post-suppression coefficients so that the amount of noise suppression is low in the speech section and high in the noise section. The result is a small speech distortion in the speech section and a small residual noise in the noise section. Details of the speech amplitude spectrum corrector 20 are shown in FIG. 8.

As shown in FIG. 8, the speech amplitude spectrum corrector 20 comprises a squaring circuit 21 for squaring the enhanced speech amplitude spectral components $|\overline{X}_n|$ from the multiplier 10 to produce a vector of K enhanced speech power spectral components $|\overline{X}_n|^2$. These power spectral components are averaged in an averaging circuit 22 by dividing the total sum of the magnitudes of spectral components by the integer K and supplied to a speech presence probability calculator 24 and a post-suppression coefficient calculator 25. The noise components $\lambda_n$ from the noise estimation circuit 5 are likewise averaged in an averaging circuit 23 by dividing their total sum by the integer K and supplied to the calculators 24 and 25.

Speech presence probability calculator 24 uses the enhanced speech power from the averaging circuit 22 and the estimated noise power from the averaging circuit 23 to produce an output indicating a mutual relationship between speech and noise. Preferably, this speech-versus-noise relationship is represented by a probability of speech presence.

Speech presence probability calculator 24 includes a log converter 240 that converts the output of the averaging circuit 22 to convert the averaged speech power to logarithm, which is scaled by integer 10 in a multiply-by-10 circuit 241. In this manner, the n-th frame enhanced speech power $E_n$ is represented as follows:

$$E_n = 10\log_{10}\left(\frac{1}{K}\sum_{k=0}^{K-1}|\overline{X}_n(k)|^2\right) \tag{1}$$

The output of the averaging circuit 23, on the other hand, is converted in a log converter 243 to logarithm and scaled by integer 10 in a multiply-by-10 circuit 244 to produce an output that represents the n-th frame estimated noise power $N_n$ as follows:

$$N_n = 10\log_{10}\left(\frac{1}{K}\sum_{k=0}^{K-1}\lambda_n(k)\right) \tag{2}$$

The relationship between the enhanced speech power $E_n$ and the estimated noise power $N_n$ is determined and based on this relationship an index that represents the amount of speech power contained in the input signal is determined. If the speech power $E_n$ is greater than the noise power $N_n$, the index assumes a value indicating that the probability of presence "p" is high. Since the estimated noise power $N_n$ and the estimated speech power $E_n$ are, in most cases, nonstationary signals, an instance that the noise power $N_n$ is greater than the speech power $E_n$ can possibly occur in a speech section. Such an instance can also occur in a noise section. Therefore, if the values $E_n$ and $N_n$ were directly used in the index calculation, the probability of speech section "p" is likely to contain an error. To perform precision index calculation, it is desirable to modifythe values $E_n$ and $N_n$ in a suitable manner.

For this purpose, the enhanced speech power $E_n$ is supplied to a pair of smoothing circuits 242*a* and 242*b* of similar configuration. In the smoothing circuit 242*a*, the enhanced speech power $E_n$ is smoothed by multiplying it by a scale factor $(1-\delta_1)$ in a multiplier 25*a*, where $\delta_1$ represents a first smoothing coefficient, producing an output $(1-\delta_1)E_n$. The latter is summed in an adder 24*b* with the output of a multiplier 24*c* that multiplies a smoothed enhanced speech power by the smoothing coefficient $\delta_1$, this enhanced speech power being one that was produced by the adder 25*b* and delayed a frame interval by a delay element 24*d*. Thus, the smoothing circuit 242*a* produces the following output from the adder 24*b*:

$$\overline{E}_{1,n}=\delta_1\overline{E}_{n-1}+(1-\delta_1)E_n \tag{3a}$$

In a similar fashion, the smoothing circuit 242*b* produces the following output:

$$\overline{E}_{2,n}=\delta_2\overline{E}_{n-1}+(1-\delta_2)E_n \tag{3b}$$

where $\delta_2$ is a second smoothing coefficient greater than the first smoothing coefficient $\delta_1$. Because of the smaller value of smoothing coefficient $\delta_1$ than $\delta_2$, the smoothing effect of the smoothing circuit 242*a* on the speech power $E_n$ is smaller than that of the smoothing circuit 242*b*. The outputs of the smoothing circuits 242*a* and 242*b* are supplied to an instantaneous index calculator 246*a* and an average index calculator 246*b*, respectively.

On the other hand, the estimated noise power $N_n$ is supplied to a pair of function value calculators 245*a* and 245*b* to produce a first function value $\hat{N}_{1,n}$ and a second function value $\hat{N}_{2,n}$, respectively, based on a linear or nonlinear function that is used for dynamic range compression or expansion or a smoothing function that is used for reducing dispersion. The function value calculations can be dispensed with to decrease the amount of computations. A typical example of the functions used in the calculators 245*a* and 245*b* is as follows:

$$\hat{N}_{1,n}=a_{fc}N_n+b_{fc} \tag{4a}$$

$$\hat{N}_{2,n}=c_{fc}N_n+d_{fc} \tag{4b}$$

where, $a_{fc}$, $b_{fc}$, $c_{fc}$, $d_{fc}$ are real numbers.

The outputs of the function value calculators 245*a* and 245*b* are supplied to the instantaneous index calculator 246*a* and average index calculator 246*b*, respectively, to which the smoothed enhanced speech power $\overline{E}_{1,n}$ and $\overline{E}_{2,n}$ are also supplied from the smoothing circuits 242*a* and 242*b* to produce indices $I_{1,n}$ and $I_{2,n}$ according to the following relations:

$$I_{1,n}=\begin{cases} a_{idx}, & \overline{E}_{1,n}/\hat{N}_{1,n}\le\theta_{idx} \\ b_{idx}, & \overline{E}_{1,n}/\hat{N}_{1,n}>\theta_{idx} \end{cases} \tag{5a}$$

$$I_{2,n}=\begin{cases} a_{idx}, & \overline{E}_{2,n}/\hat{N}_{2,n}\le\theta_{idx} \\ b_{idx}, & \overline{E}_{2,n}/\hat{N}_{2,n}>\theta_{idx} \end{cases} \tag{5b}$$

where, $a_{idx}$, $b_{idx}$, $\theta_{idx}$ are real numbers and $a_{idx}$ is greater than $b_{idx}$. By adding some constant value to the denominators of the above relations, dispersion can be avoided. Alternatively, a difference between $E_n$ and $N_n$ or the normalized value of the difference can also be used. Since the smoothing effect of the smoothing circuit 242*a* on the speech power $E_n$ is smaller than that of the smoothing circuit 242*b* as described above, the less-smoothed output $\overline{E}_{1,n}$ of the smoothing circuit 242*a* is suitable for calculating the instantaneous index $I_{1,n}$ and the more-smoothed output $\overline{E}_{2,n}$ of the smoothing circuit 242*b* is suitable for calculating the average index $I_{2,n}$.

The outputs of the index calculators 246*a* and 246*b* are summed in an adder 247 to produce an output as the probability of a speech presence "p". Note that, instead of using the adder 247, a weighted sum or multiplication can equally be used.

The function of the post-suppression coefficient calculator 25 is to calculate a vector of post-suppression coefficients according to the probability "p" of speech presence supplied from the calculator 24. As described below, when the probability "p" is low, the post-suppression coefficient calculator 25 uses a weighting factor that contains a higher ratio of a nonspeech-section correction factor to produce a vector of low post-suppression coefficients. As a result, the residual noise in noise sections can be further reduced. Conversely, when the probability "p" is low, the post-suppression coefficient calculator 25 uses a weighting factor that contains a higher ratio of a speech-section correction factor to produce a vector of high post-suppression coefficients that are equal to or slightly greater than the vector of corrected noise-suppression coefficients $\overline{G}_n$ supplied from the suppression coefficient corrector 9. In this way, when the speech presence probability "p" is high, over-suppression of speech can be avoided.

Specifically, the post-suppression coefficient calculator 25 includes an nonspeech section correction factor calculator 250 that produces a nonspeech section correction factor $F_U$, using the outputs of the averaging circuits 22 and 23 and a speech presence probability "p" supplied from the speech presence probability calculator 24.

The nonspeech section correction factor calculator 250 includes a mixer 25*a* that mixes the enhanced speech power from the averaging circuit 22 with averaged speech power stored in a memory 25*b* in a proportion determined by the speech presence probability "p". The stored speech power was the output of the mixer 25*a* of the previous frame and smoothed in a smoothing circuit 25*c* using an externally applied smoothing coefficient.

In the mixer 25*a*, if the speech presence probability "p" is relatively high, a greater proportion of the averaged speech of the current frame is mixed with a smaller proportion of the smoothed speech of the previous frame. If the speech presence probability "p" is relatively low, a greater proportion of the smoothed speech of the previous frame is mixed in the mixer 25*a* with a smaller proportion of the averaged speech of the current frame.

Therefore, when the probability "p" is relatively low, the input signal of the smoothing circuit 25*c* has a higher content of the smoothed previous frame and hence its output signal is not substantially updated. As a result, the smoothing circuit 25*c* produces the same enhanced speech power during a noise section as that calculated during a speech section. On the other hand, if the probability "p" is relatively high, the smoothing circuit 25*c* uses a signal that contains a greater amount of the averaged enhanced speech power to perform its smoothing operation on the output of the mixer 25*a*, and hence its output is updated.

The reason for the smoothing circuit 25*c* not updating its output during nonspeech sections but updating its output during speech sections is that the input speech signal is measured in terms of the speaker's volume ranging from low voice to loud voice. If a speaker utters a loud voice in a quiet environment, the reliability of the calculated probability "p" of speech presence is high and if the speaker's voice is low in a noisy environment the reliability of the probability "p" is low.

The smoothed enhanced speech power from the smoothing circuit 25*c* is divided in a division circuit 25*d* by the average power of the estimated noise components $\lambda_n$ to produce a signal-to-noise ratio, which is converted to logarithm in a log converter 25*e*. As it is seen from the function of the mixer 25*a* described above, when the speech presence probability "p" is low, the smoothing circuit 25*c* uses a signal that contains a greater amount of the smoothed enhanced speech power of the previous frame to calculate a smoothed enhanced speech power of the current frame. Therefore, the smoothed enhanced speech power is not substantially updated when the probability "p" is low. As a result, during noise sections the smoothing circuit 25*c* generates the same enhanced speech power calculated during speech sections. On the other hand, during sections where the speech presence probability "p" is high, the smoothing circuit 25*c* uses a signal that contains a greater amount of enhanced average speech power to calculate the smoothed enhanced speech power.

The output of the division circuit 25*d* thus represents the ratio of the enhanced average speech power to the estimated noise power, i.e., the signal-to-noise ratio of the enhanced average speech power. The output of the log converter 25*e* is scaled by the integer "10" in a multiply-by-10 circuit 25*f* and supplied to a weighting calculator 25*g*.

Based on the SNR of the enhanced average speech power thus obtained above, the weighting calculator 25*g* calculates a correction factor that represents the amount of suppression to be imposed on nonspeech sections by incorporating the reliability of the probability "p" of speech presence into the calculation. When the SNR of the enhanced average speech power is high (i.e, when the reliability of the probability "p" is high), there is less likelihood of a speech section being suppressed in error. In this case, therefore, the correction factor is set to a low value to increase the amount of suppression. On the other hand, when the SNR of the enhanced average speech power is low (i.e., the reliability of the probability "p" is low), the likelihood of a speech section being suppressed in error y is high. Therefore, in order to prevent the speech section being suppressed in error when the SNR of the enhanced average speech power is high, the correction factor is set to a high value to decrease the amount of suppression.

Figure 9:
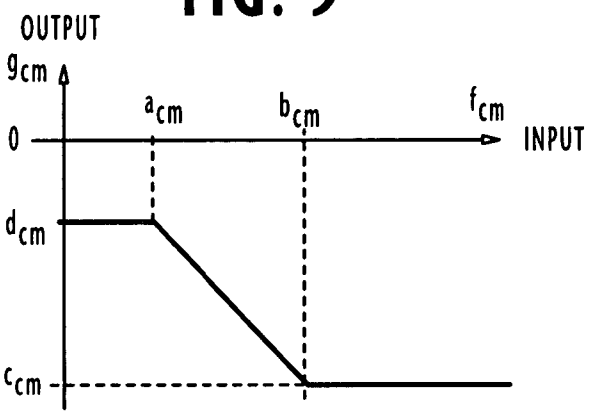
FIG. 9 is a graphic representation of the characteristic of the weighting calculator of FIG. 8.

The calculation of such nonspeech presence SNR value has the effect of incorporating the reliability of the speech presence probability into the unvoiced suppression coefficient. When the nonspeech presence SNR value is high, i.e., when the reliability of the speech presence probability "p" is high, there is less likelihood of erroneously suppressing a speech section. In this case, the output of the weighting calculator 25*g* is low to increase the degree of suppression. On the other hand, when the nonspeech presence SNR value is low, i.e., when the reliability of the speech presence probability "p" is low, the output of the weighting calculator 25*g* is high to decrease the degree of suppression in order to prevent the speech section from being erroneously suppressed. FIG. 9 is a graph representing a typical example of nonlinear functions that can be used to calculate the unvoiced suppression coefficient. In FIG. 9, $f_{cm}$ represents an input value and $g_{cm}$ represents an output value given by the following relation:

$$g_{cm} = \begin{cases} d_{cm}, & f_{cm} \le a_{cm} \\ \dfrac{(d_{cm} - c_{cm})f_{cm} + a_{cm}c_{cm} - b_{cm}d_{cm}}{a_{cm} - b_{cm}}, & a_{cm} < f_{cm} \le b_{cm} \\ c_{cm}, & b_{cm} < f_{cm} \end{cases} \quad (6)$$

where $a_{cm}$, $b_{cm}$, $c_{cm}$, $d_{cm}$ are positive real numbers. The nonlinear function shown in FIG. 9 indicates that as the input value increases the output value decreases.

The unvoiced suppression coefficient obtained in a manner as discussed above is divided by integer "10" in a divide-by-10 circuit 25*h* and supplied to an exponent calculator 25*i* where the output of the divide-by-10 25*h* is converted to an exponential value which represents an nonspeech presence correction factor $F_U$.

Post-suppression coefficient calculator 25 includes a combined coefficient calculator 251 that receives the nonspeech section correction factor $F_U$ and the probability "p" and a speech section correction factor $F_V$ and produces a combined coefficient F represented by:

$$F = pF_V + (1-p)F_U \quad (7)$$

It is seen that if the value of probability "p" is large, the speech presence correction factor $F_V$ accounts for a greater part of the combined coefficient F. Combined coefficient F can also be obtained according to the following Equation:

$$F = pF_{SFC}(F_V) + (1-p)G_{SFC}(F_U) \quad (8)$$

where $F_{SFC}$ and $G_{SFC}$ are different function values.

In a multiplier 252, the noise suppression coefficients $\overline{G}_n$ supplied from the noise suppression coefficients corrector 9 are weighted by the post-suppression coefficient F to produce a vector of post-suppression coefficients $F \cdot \overline{G}_n$.

The speech amplitude components $|Y_n|$ are weighted respectively by the post-suppression coefficients in a spectral multiplier 26 and the output vector of the spectral multiplier 26 are supplied to the multiplier 11.

The benefit of weighting the speech amplitude components $|Y_n|$ with the post-suppression coefficients $F \cdot \overline{G}_n$ is that noise suppression can be provided at relatively low level in speech sections and at relatively high level in noise sections. The result is small speech distortion in speech sections and small residual noise in noise sections.

Figure 10:
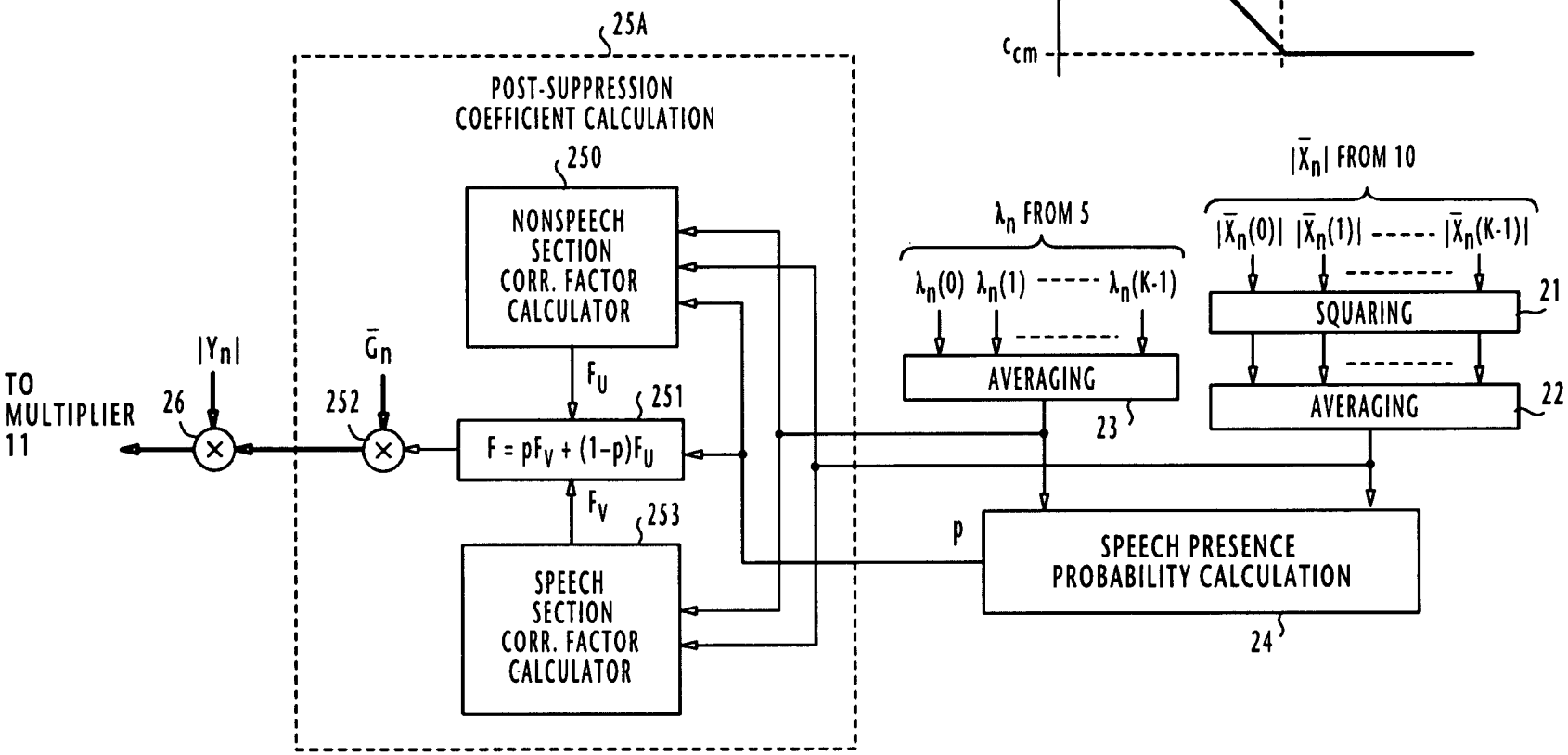
FIG. 10 is a block diagram of a modification of the first embodiment of the invention.

A first modification of FIG. 7 is shown in FIG. 10, in which a post-suppression coefficient calculator 25A is a modified form of the post-suppression coefficient calculator 25 of FIG. 8. The modified calculator 25A additionally includes a speech presence coefficient calculator 253 that receives the outputs of the averaging circuits 22 and 23 and produces an output value $F_V$ to the combined coefficient calculator 251 by comparing the estimated noise power with the enhanced speech power.

When the estimated noise power is greater than the enhanced speech power (i.e., SNR is low), $F_V$ assumes a value in a range from 1.0 to some higher number determined as a function of the ratio of the estimated noise power to the enhanced speech power. Since there is a likelihood of the corrected noise suppression coefficients $\overline{G}_n$ becoming smaller than optimum values, the setting of the value $F_V$ greater than 1.0 prevents the noise suppression coefficients $\overline{G}_n$ from performing over-suppression on the speech section. In this case, the greater-than-1 output value is variable depending on the ratio of the estimated noise power to the enhanced speech power. On the other hand, when the estimated noise power is smaller than the enhanced speech power (i.e., the SNR is high), over-suppression is less likely to occur during a speech section. In this case, $F_V$ assumes a constant value greater than 1.0, which is appropriately determined regardless of the ratio of the estimated noise power to the enhanced speech power.

Figure 11:
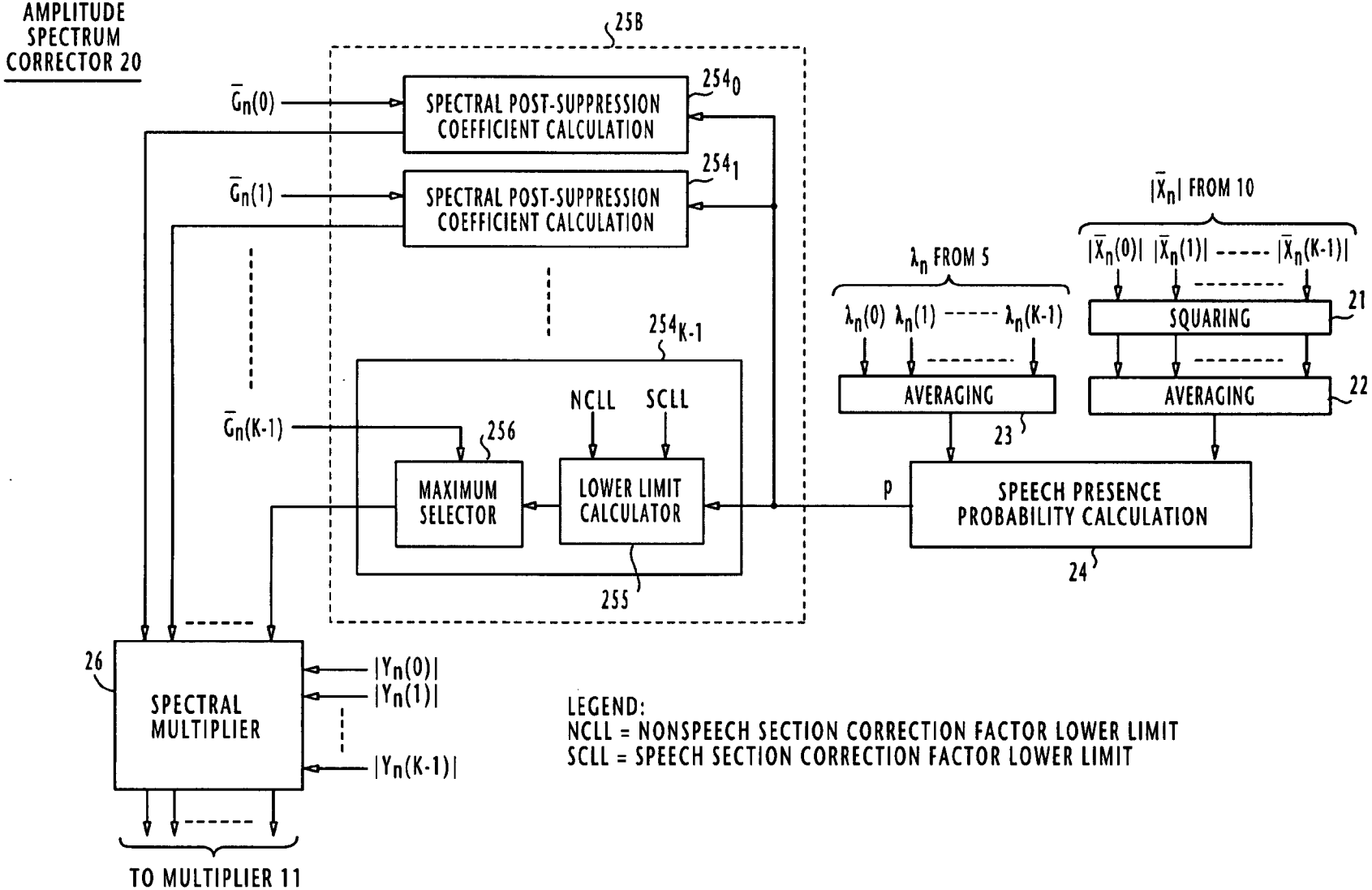
FIG. 11 is a block diagram of the noise suppressor of a second embodiment of the present invention.

A second embodiment of the present invention is shown in FIG. 11, in which the post-suppression coefficient calculator 25 of FIG. 8 is modified as a post-suppression coefficient calculator 25B. In this embodiment, the calculator 25B comprises a plurality of spectral post-suppression coefficient calculators $\mathbf{254}_0$~$\mathbf{254}_{K-1}$ of identical configuration. Each spectral post-suppression coefficient calculator 254 includes a lower limit calculator 255 and a maximum selector 256. Lower limit calculator 255 is supplied with a speech section correction factor lower limit (SCLL) value and an nonspeech section correction factor lower limit (NCLL) value and calculates a lower limit value of noise suppression coefficient according to the probability value "p" supplied from the speech presence probability calculator 24 such that the portion of the SCLL value that contributes to the output value of calculator 255 increases with the speech presence probability value "p". Equations (7) and (8) can be used to determine the contributing factor of the voiced factor lower limit. In order to prevent the distortion of voiced sound, the speech section correction factor lower limit (SCLL) value is set at a value greater than the nonspeech section correction factor lower limit (NCLL) value. The output of the lower limit calculator 255 is supplied to the maximum selector 256 to which one of the corrected noise suppression coefficients $\overline{G}_n(k)$ that corresponds to the spectral post-suppression coefficient calculator $\mathbf{254}_k$ is also applied. Maximum selector 256 selects a greater of the two input values and feeds the selected value to the spectral multiplier 27.

As a result, the spectral post-suppression coefficient $\overline{G}_n$ is supplied to the multiplier 26 in so far as it is higher than the lower limit value established by the speech presence probability "p". Since the lower limit value established in this way is large when the speech presence probability "p" is high, speech distortion that can occur in speech sections due to over-suppression can be prevented. On the other hand, when the speech presence probability "p" is low, the lower limit value is small. Hence, it is possible to optimize the amount of noise suppression imposed on noise sections.

Figure 12:
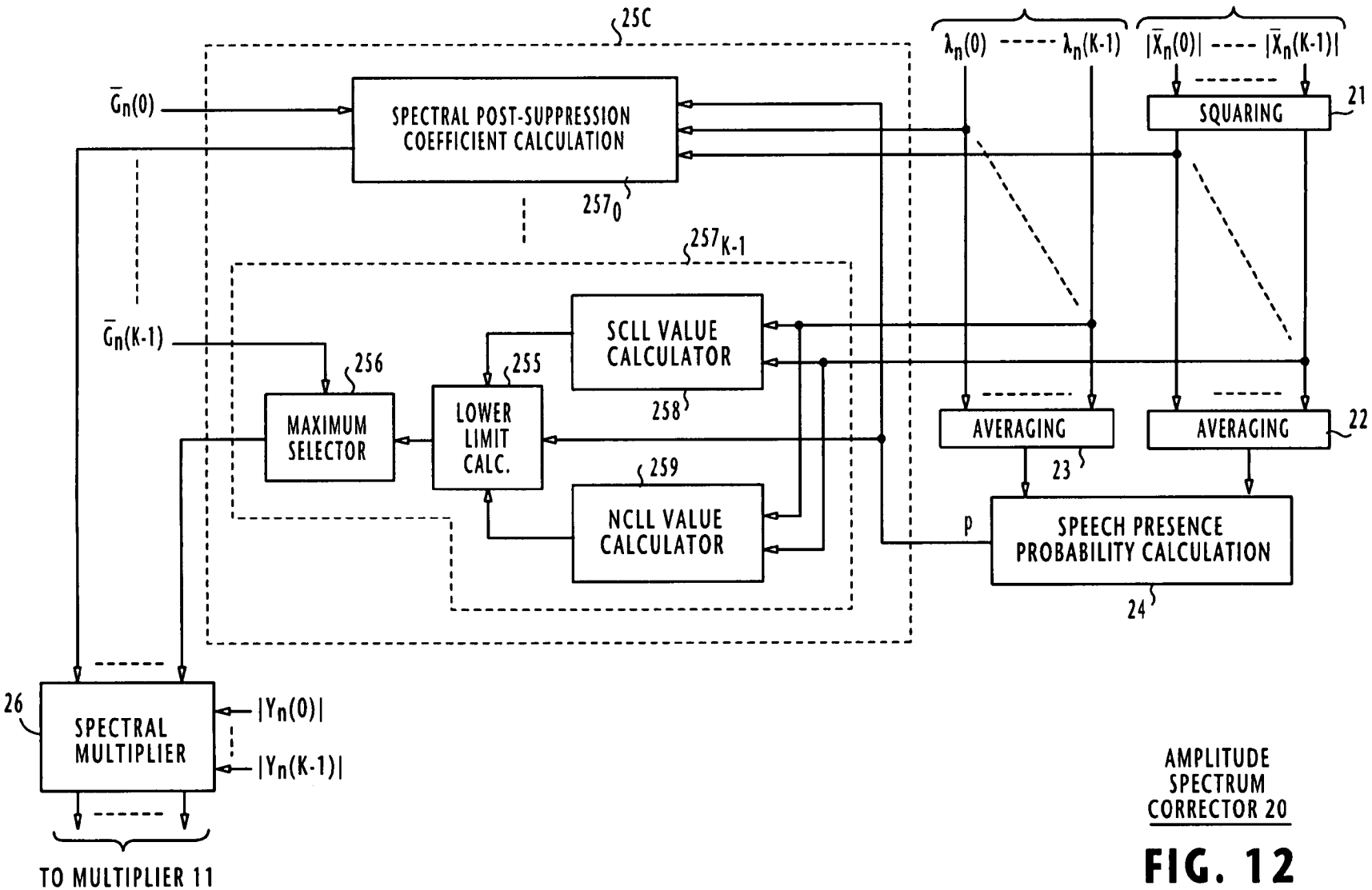
FIG. 12 is a block diagram of a first modification of the second embodiment of the invention.

A modification of the second embodiment is shown in FIG. 12, in which the post-suppression coefficient calculator 25 of FIG. 8 is modified as a post-suppression coefficient calculator 25C. In this modification, the calculator 25C comprises a plurality of spectral post-suppression coefficient calculators $\mathbf{257}_0$~$\mathbf{257}_{K-1}$ of identical configuration. Each spectral post-suppression coefficient calculator 257 is different from that of the calculator 254 of FIG. 11 in that it additionally includes a speech section correction factor lower limit (SCLL) calculator 258 and an nonspeech section correction factor lower limit (NCLL) calculator 259. Calculators 258 and 259 receive a corresponding one of the estimated noise power spectral components $\lambda_n(0)$~$\lambda_n(K-1)$ from the noise estimation circuit 5 and a corresponding one of the enhanced speech power spectral components $|\overline{X}_n(0)|^2$~$|\overline{X}_n(K-1)|^2$ from the squaring circuit 21 corresponding to their spectral number. Voiced factor lower limit calculator 258 calculates a voiced factor lower limit value depending on the signal-to-noise ratio of the enhanced speech component $|\overline{X}_n(k)|^2$ to the estimated noise spectral sample $\lambda_n(k)$, where k is one of 0, 1, . . . , K−1. Likewise, the unvoiced factor lower limit calculator 259 calculates an unvoiced factor lower limit value depending on the same signal-to-noise ratio. The calculated speech section correction factor lower limit (SCLL) and nonspeech section correction factor lower limit (NCLL) values are supplied to the lower limit calculator 255.

To decrease speech distortion in speech sections, the speech section correction factor lower limit (SCLL) value is determined so that it varies inversely with the SNR value. In order to decrease residual noise in nonspeech sections and prevent over-suppression in speech sections, the nonspeech section correction factor lower limit (NCLL) is set at a value lower than the speech section correction factor lower limit (SCLL) value. The calculators 258 and 259 are preferably designed so that the difference between their lower limit values does not exceed some critical value when the SNR is relatively low. If such a difference is greater than the critical value, the difference in residual noise between the voiced and nonspeech sections increases, which would result in a distorted sound being perceived in speech sections. Conversely, when the SNR is high, the residual noise in speech sections is less likely to be perceived due to the masking effect of a voiced sound. As in the case of low SNR values, the differential residual noise between the voiced and nonspeech sections does not become a contributing factor of speech distortion in speech sections. For this reason, if the SNR is high, the calculators 258 and 259 are designed to maintain a relatively large difference between their output values so that the residua noise of nonspeech sections is sufficiently reduced. The nonspeech section correction factor lower limit (NCLL) value is determined depending on the speech section correction factor lower limit (SCLL) value. Basically, as in the case of the speech section correction factor lower limit (SCLL) value, the nonspeech section correction factor lower limit (NCLL) value increases when the SNR decreases.

Figure 13:
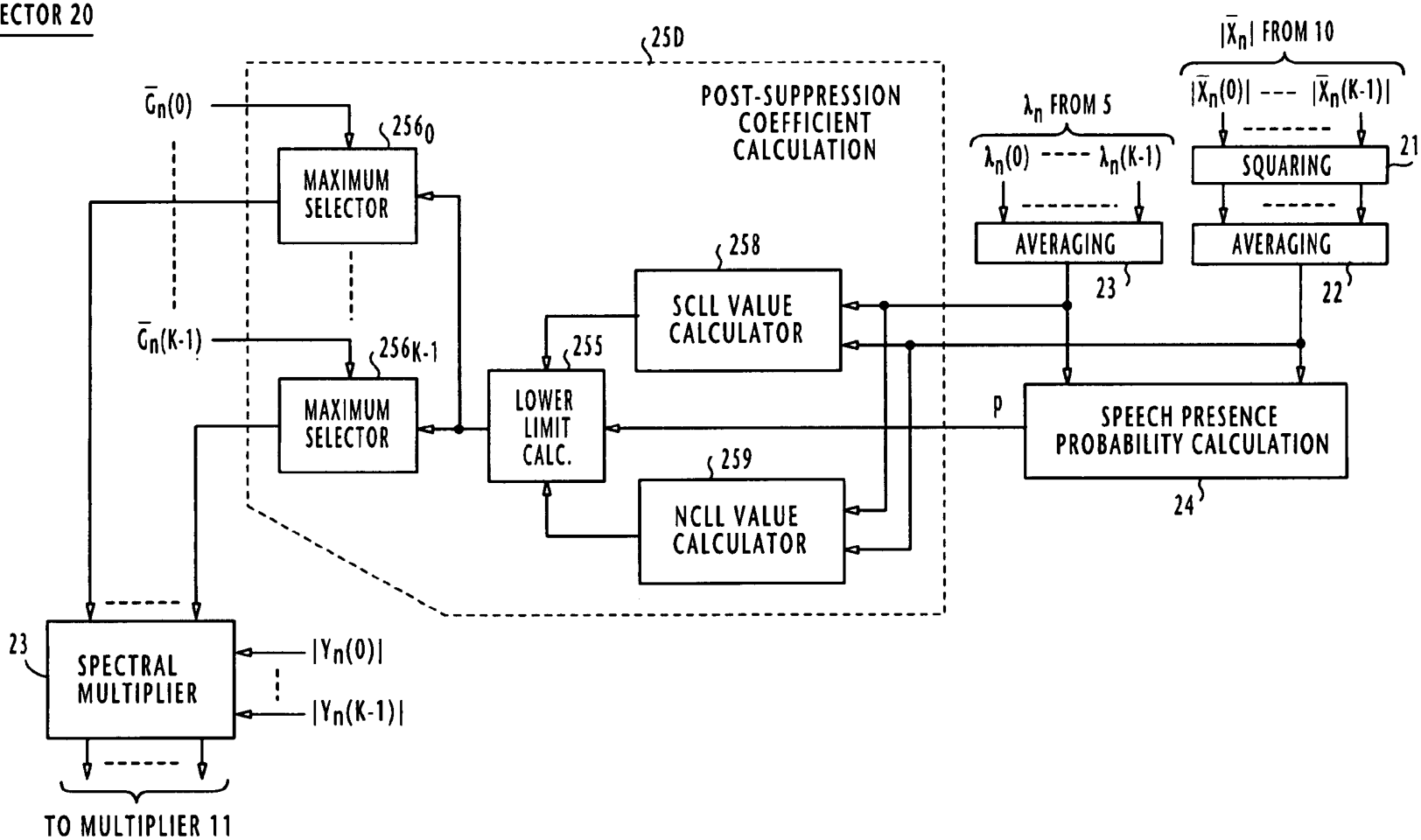
FIG. 13 is a block diagram of a second modification of the second embodiment.

As a modification of the second embodiment of this invention, it is preferable that the calculators 258 and 259 use averaged values of the estimated noise power spectral components and the enhanced speech power components for calculating the SNR values, as illustrated in FIG. 13. In this modification, the post-suppression coefficient calculator 25D includes only one vector of speech section correction factor lower limit (SCLL) calculator 258, nonspeech section correction factor lower limit (NCLL) calculator 259 and lower limit calculator 255. The outputs of the averaging circuits 22 and 23 are supplied to the calculators 258 and 259, and the output of the lower limit calculator 255 is supplied to maximum selectors $\mathbf{256}_0$~$\mathbf{256}_{K-1}$. The output of speech presence probability calculator 24 is connected to all maximum selectors 256.

Figure 14:
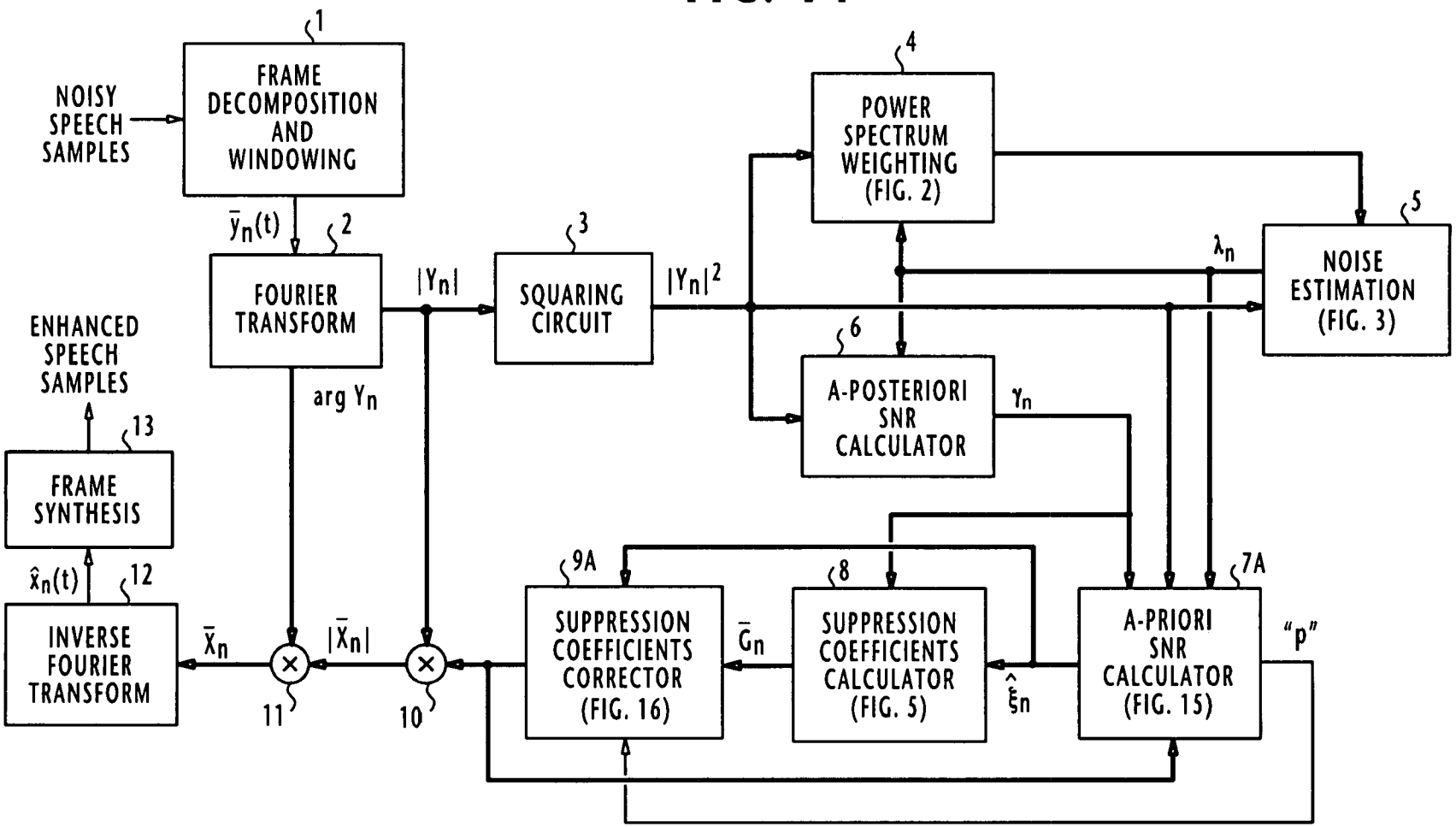
FIG. 14 is a block diagram of a noise suppressor for speech signals according to a third embodiment of the present invention.

A third embodiment of the noise suppressor of this invention is shown in FIG. 14 in which elements corresponding to those of FIG. 7 bear the same reference numerals. The third embodiment differs from the first embodiment in that an a-priori SNR calculator 7A and a noise suppression coefficients corrector 9A are used instead of the amplitude spectrum corrector 20 of FIG. 7, and the a-priori SNR calculator 7 and suppression coefficients corrector 9 of FIG. 1. A-priori SNR calculator 7A differs from the prior-art calculator 7 in that it additionally receives the outputs of squaring circuit 3 and noise estimation circuit 5.

Figure 15:
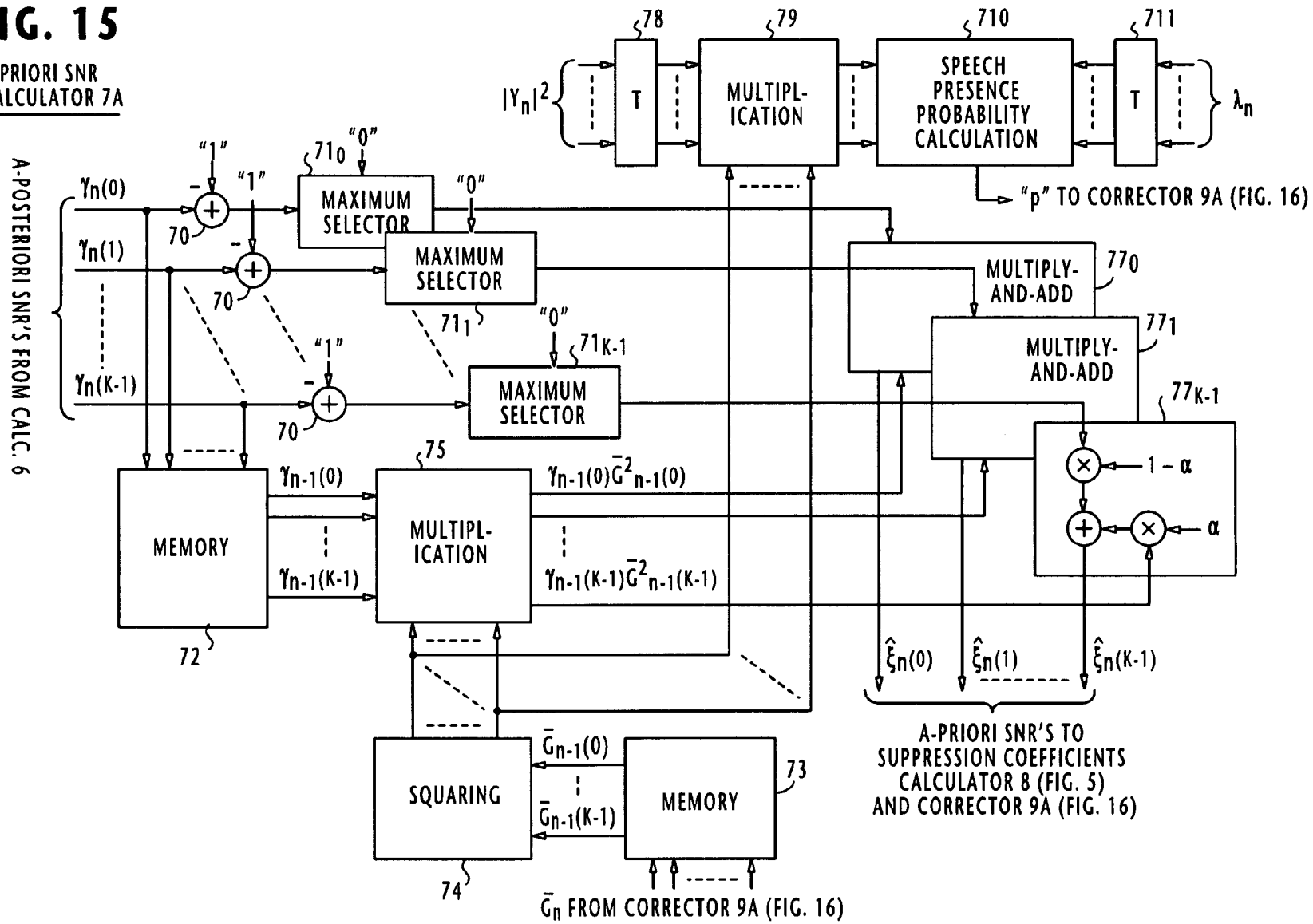
FIG. 15 is a block diagram of the a-priori SNR calculator of FIG. 14.

As shown in detail in FIG. 15, the a-priori SNR calculator 7A is generally similar in configuration to the prior-art calculator 7 of FIG. 1 with the exception that it additionally includes a delay element 78, a multiplier 79, a speech presence probability calculator 710 and a delay element 711. The speech power spectral components $|Y_n|^2$ from the squaring circuit 3 are delayed for a frame interval in the delay element 78 and supplied to the multiplier 79 where they are respectively multiplied by the corrected noise suppression coefficients $\overline{G}_{n-1}{}^2$ of the previous frame supplied from the squaring circuit 74. Thus, the multiplier 79 produces outputs $|Y_{n-1}|^2$ $\overline{G}_{n-1}{}^2$, which are supplied to the speech presence probability calculator 710 as estimates of enhanced speech power components of the current frame "n".

The estimated noise power components $\lambda_n$ from the noise estimation circuit 5 are delayed for a frame interval in the delay element 711 and supplied to the speech presence probability calculator 710. In this way, the input spectral signals of the speech presence probability calculator 710 are aligned in frame with each other. Speech presence probability calculator 710 is identical in configuration to the speech presence probability calculator 24 (FIG. 8) to produce a speech presence probability "p" and sends it to the noise suppression coefficient corrector 9A.

Figure 16:
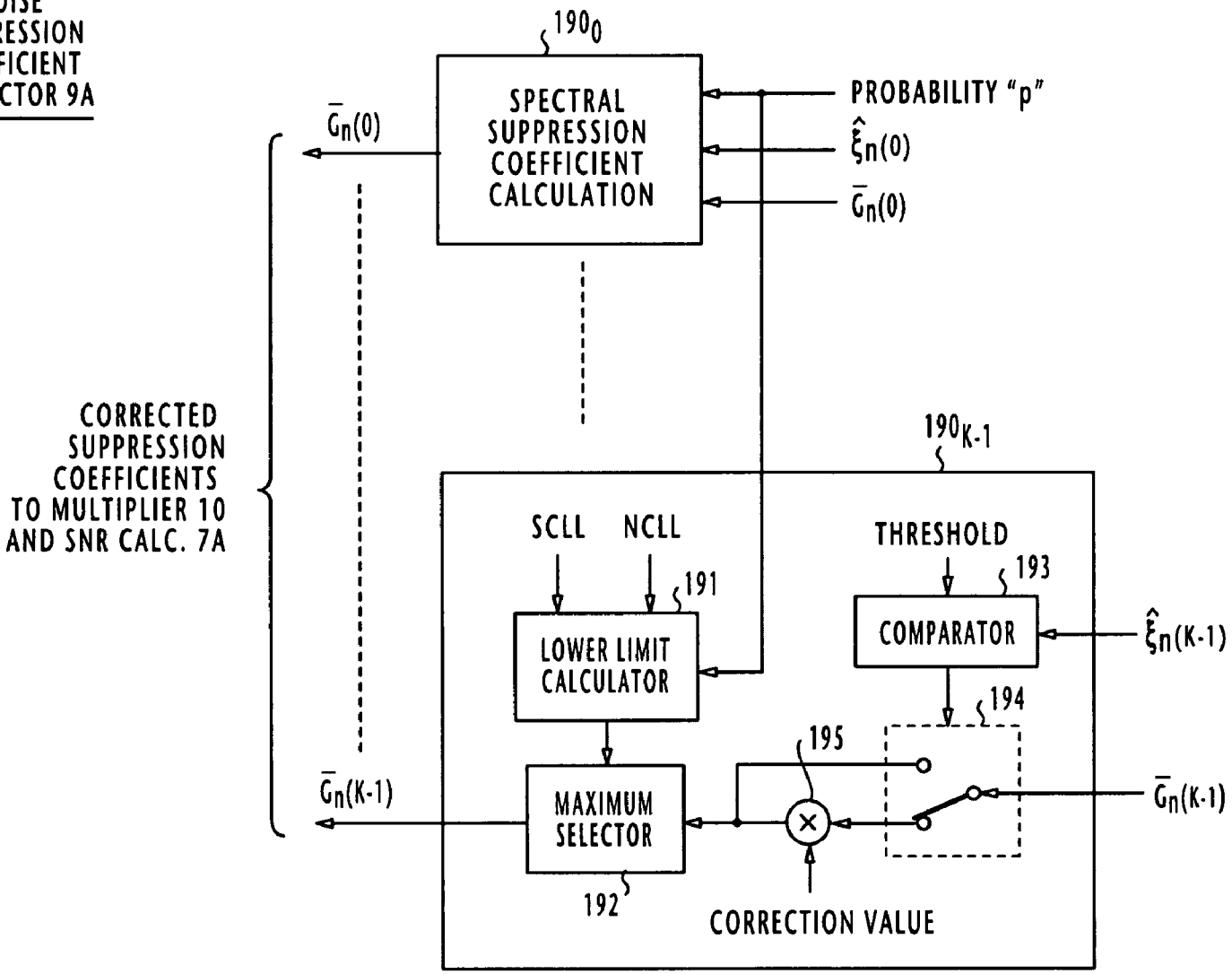
FIG. 16 is a block diagram of the noise suppression coefficient corrector of FIG. 14.

As shown in FIG. 16, the noise suppression coefficient corrector 9A includes spectral (noise) suppression coefficient calculators $\mathbf{190}_0$~$\mathbf{190}_{K-1}$ of identical configuration. Each of the calculators $\mathbf{190}_k$ receives the probability "p" and a corresponding noise suppression coefficient $\overline{G}_n$ from the noise suppression coefficients calculator 8 and a corresponding a-priori SNR $\hat{\xi}_n$ from the calculator 7A. Each of the calculators $\mathbf{190}_0$~$\mathbf{190}_{K-1}$ comprises a lower limit calculator 191 that calculates a lower limit value from a speech section correction factor lower limit (SCLL) value and an nonspeech section correction factor lower limit (NCLL) value according to the probability "p" in a manner identical to that described previously with reference to the spectral post-suppression coefficient calculators $\mathbf{254}_0$~$\mathbf{254}_{K-1}$ (FIG. 11). The output of the calculator 191 is compared in a maximum selector 192 with a suppression coefficient $\overline{G}_n$ which is supplied direct through a selector 194 when the latter is switched in the upper position or a suppression coefficient $\overline{G}_n$ which is scaled in a multiplier 195 with a correction value when the switch 194 is in the lower position. A comparator 193 compares the a-priori SNR $\hat{\xi}_n$ with a threshold value and produces a control signal that switches the selector 194 to the upper position when the SNR $\hat{\xi}_n$ is higher than the threshold value and switches the selector 194 to the lower position when the SNR is lower than the threshold value. Maximum selector 192 selects a higher of the two input values and sends the selected value to the multiplier 10 (FIG. 15) and the memory 73 of a-posteriori SNR calculator 7A (FIG. 16).

As a result, the spectral post-suppression coefficient $\overline{G}_n(k)$ is supplied to the multiplier 10 in so far as it is higher than the lower limit value established by the speech presence probability "p" and speech distortion that can occur in speech sections due to over-suppression can be prevented.

Figure 17:
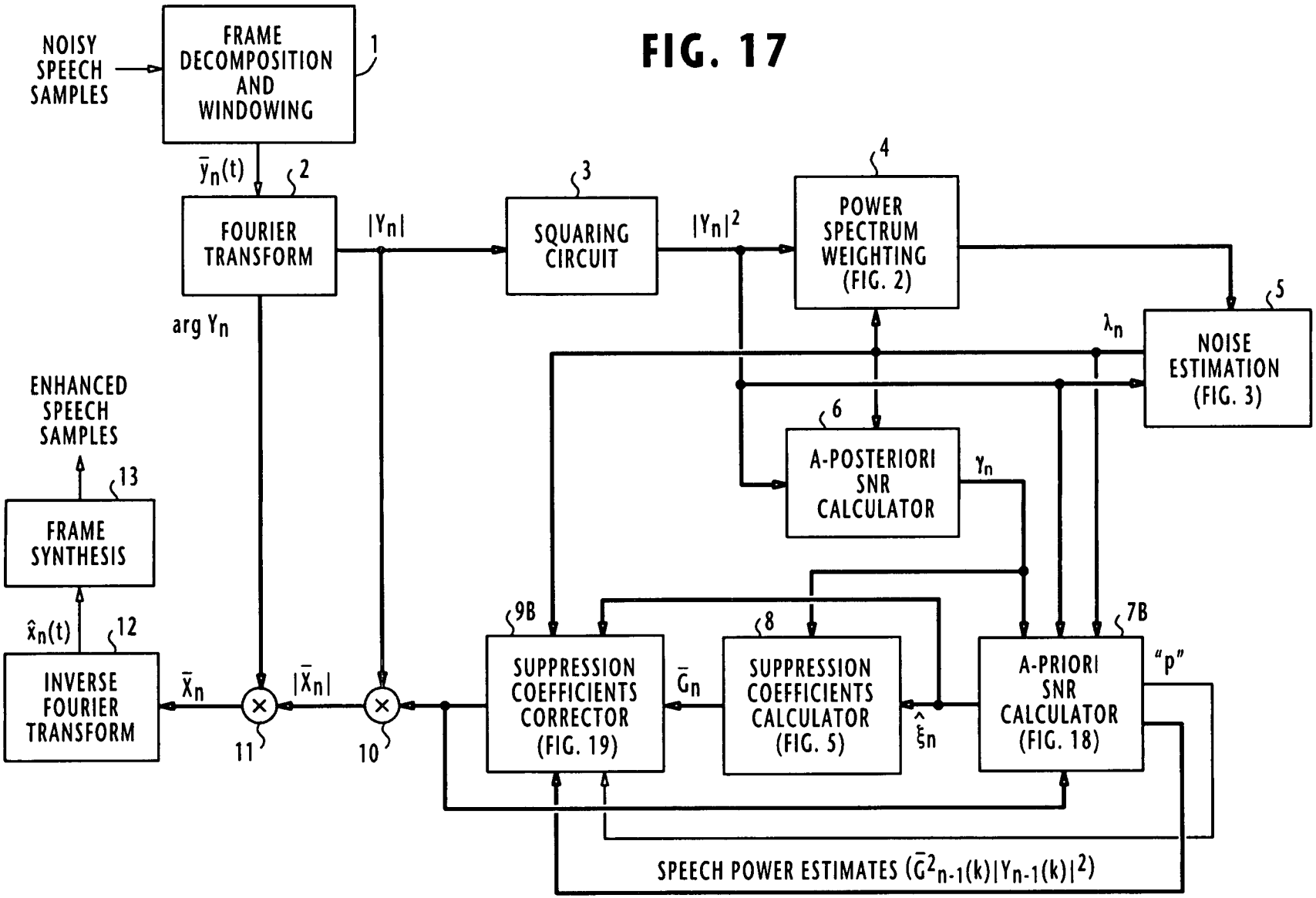
FIG. 17 is a block diagram of a modification of the third embodiment of this invention.
Figure 18:
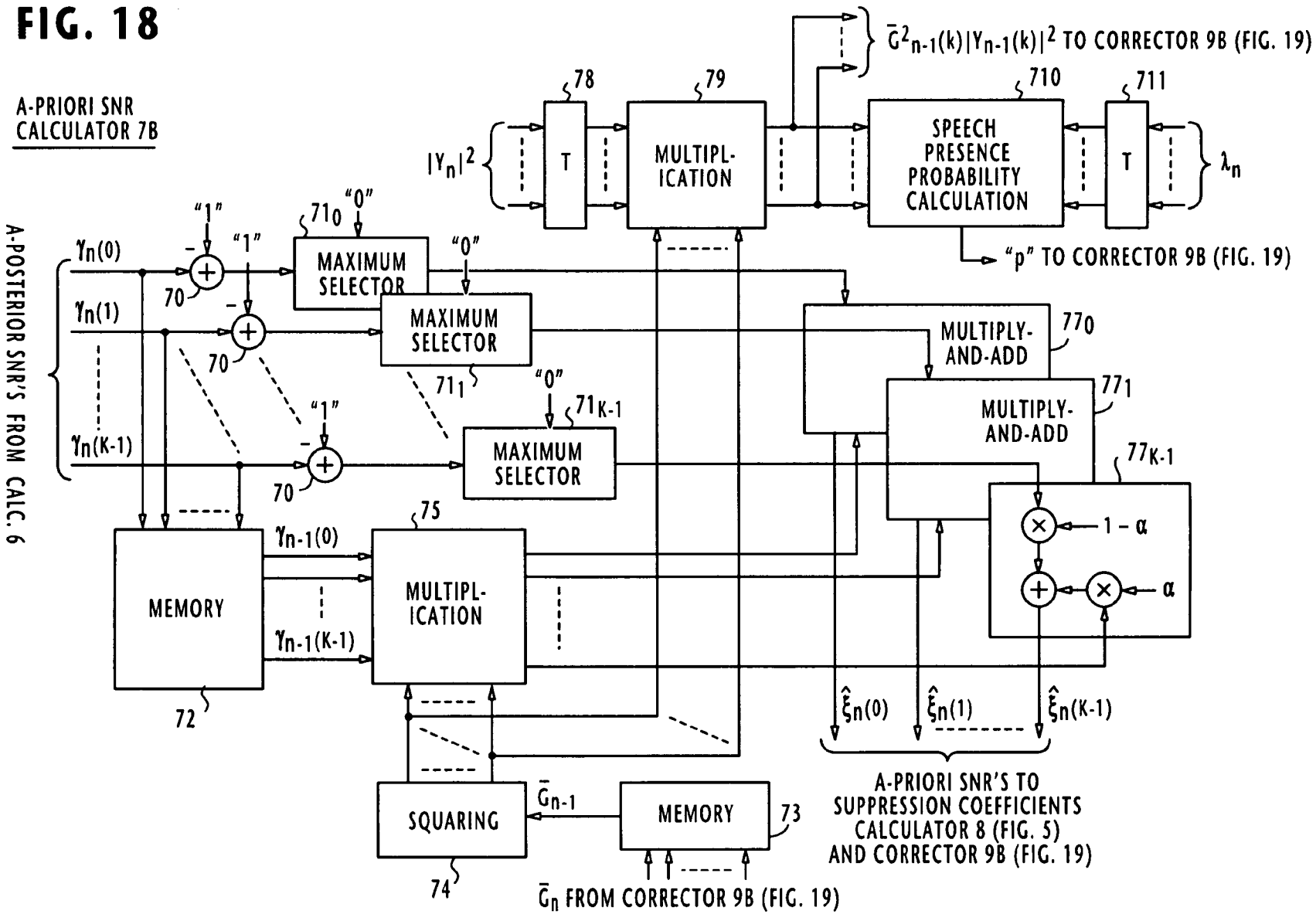
FIG. 18 is a block diagram of the a-priori SNR calculator of FIG. 17.

A modification of the third embodiment of FIG. 14 is shown in FIG. 17 in which the a-priori SNR calculator 7B and the suppression coefficients corrector 9B are provided. As shown in FIG. 18, the a-priori SNR calculator 7B is identical to the calculator 7A of FIG. 15 except that it supplies the outputs $|Y_{n-1}|^2\overline{G}_{n-1}^2$ of multiplier 79 as estimates of enhanced speech power components of the current frame "n" to the suppression coefficient corrector 9B. Suppression coefficient corrector 9B receives the estimated noise power spectral components $\lambda_n$ from the noise estimation circuit 5 and the enhanced speech power estimates $\overline{G}_{n-1}^2|Y_{n-1}|^2$ from the a-priori SNR calculator 7B, in addition to the speech presence probability value "p" and the noise suppression coefficients $\overline{G}_n$.

Figure 19:
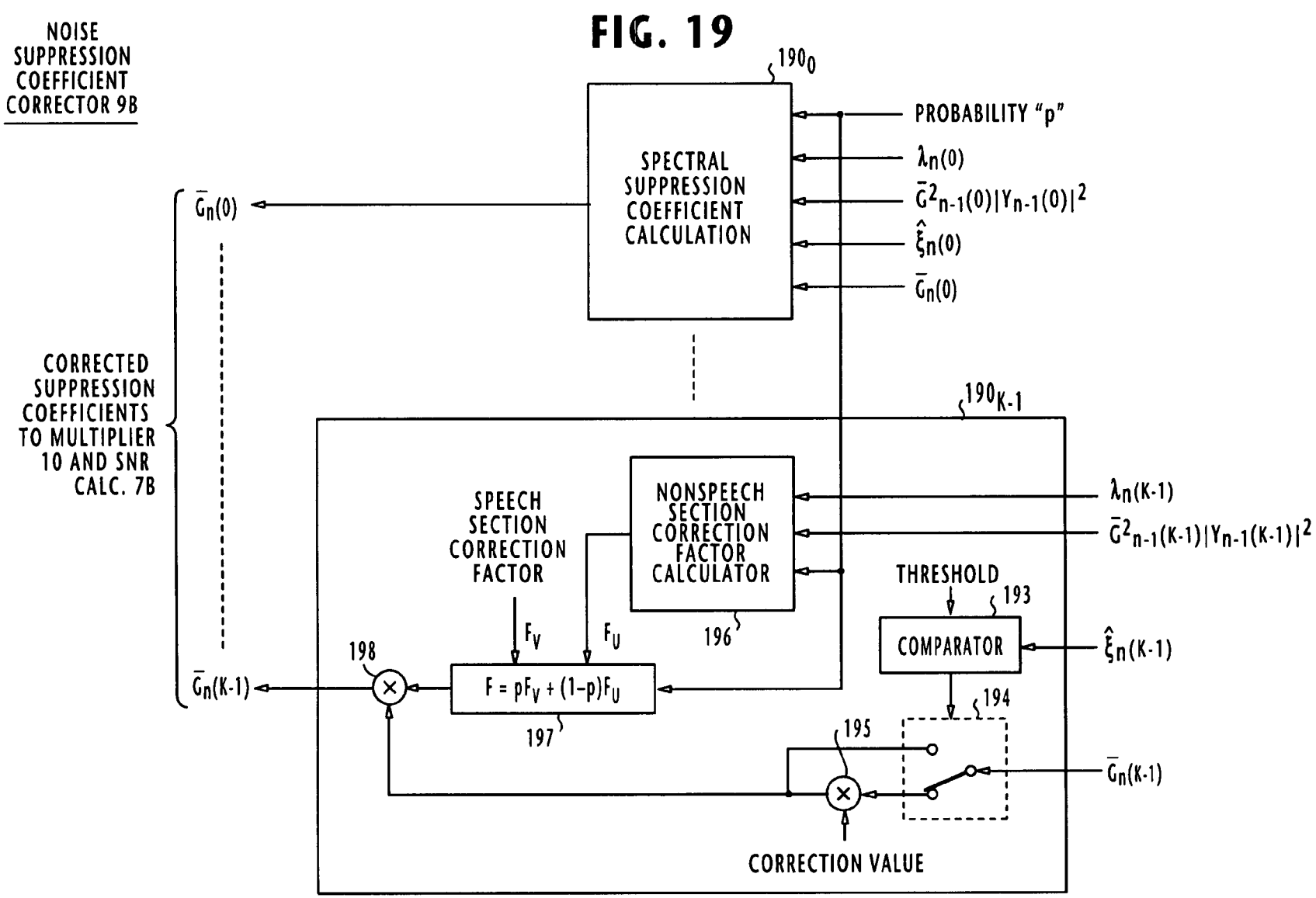
FIG. 19 is a block diagram of the noise suppression coefficient corrector of FIG. 17.

As shown in FIG. 19, the suppression coefficient corrector 9B is identical to the suppression coefficient corrector 9A of FIG. 16 except that it includes a nonspeech section correction factor calculator 196, a combined coefficient calculator 197 and a multiplier 198, instead of the lower limit calculator 191 and maximum selector 192 of FIG. 16.

Nonspeech section correction factor calculator 196 uses the probability value "p", the estimated noise power spectral component $\lambda_n$ and the estimate of an enhanced speech power component $\overline{G}_{n-1}^2|Y_{n-1|}^2$ to calculate a nonspeech section correction factor $F_U$ in a manner similar to the nonspeech section correction factor calculator 250 of FIG. 8 that uses the mean value of enhanced speech power spectral components $|\overline{X}_n|^2$ from the averaging circuit 22. In particular, the nonspeech section correction factor calculator 196 treats the enhanced speech power estimate $\overline{G}_{n-1}^2|Y_{n-1}|^2$ as a primary factor to determine the nonspeech section correction factor $F_U$.

The nonspeech section correction factor $F_U$ calculated in this manner is supplied to the combined coefficient calculator 197 to which a speech section correction factor $F_V$ is also applied. Calculator 197 is identical to the calculator 251 of FIG. 8 to calculate a combined coefficient F using the correction factors $F_U$, $F_V$ and probability "p". Multiplier 198 multiplies the output of the calculator 197 by a non-corrected noise suppression coefficient $\overline{G}_n$, which is supplied direct through the selector 194 or a corrected noise suppression coefficient $\overline{G}_n$ supplied via the multiplier 195.

Since the noise suppression coefficients $\overline{G}_n$ are corrected in the multiplier 198 by the correction factors that are calculated according to the speech section probability "p", and since the estimates of speech power spectral components are updated in the a-priori SNR calculator 7B through a feedback loop using the corrected suppression coefficients $\overline{G}_n$, residual noise in noised sections can be further suppressed efficiently.

Figure 5:
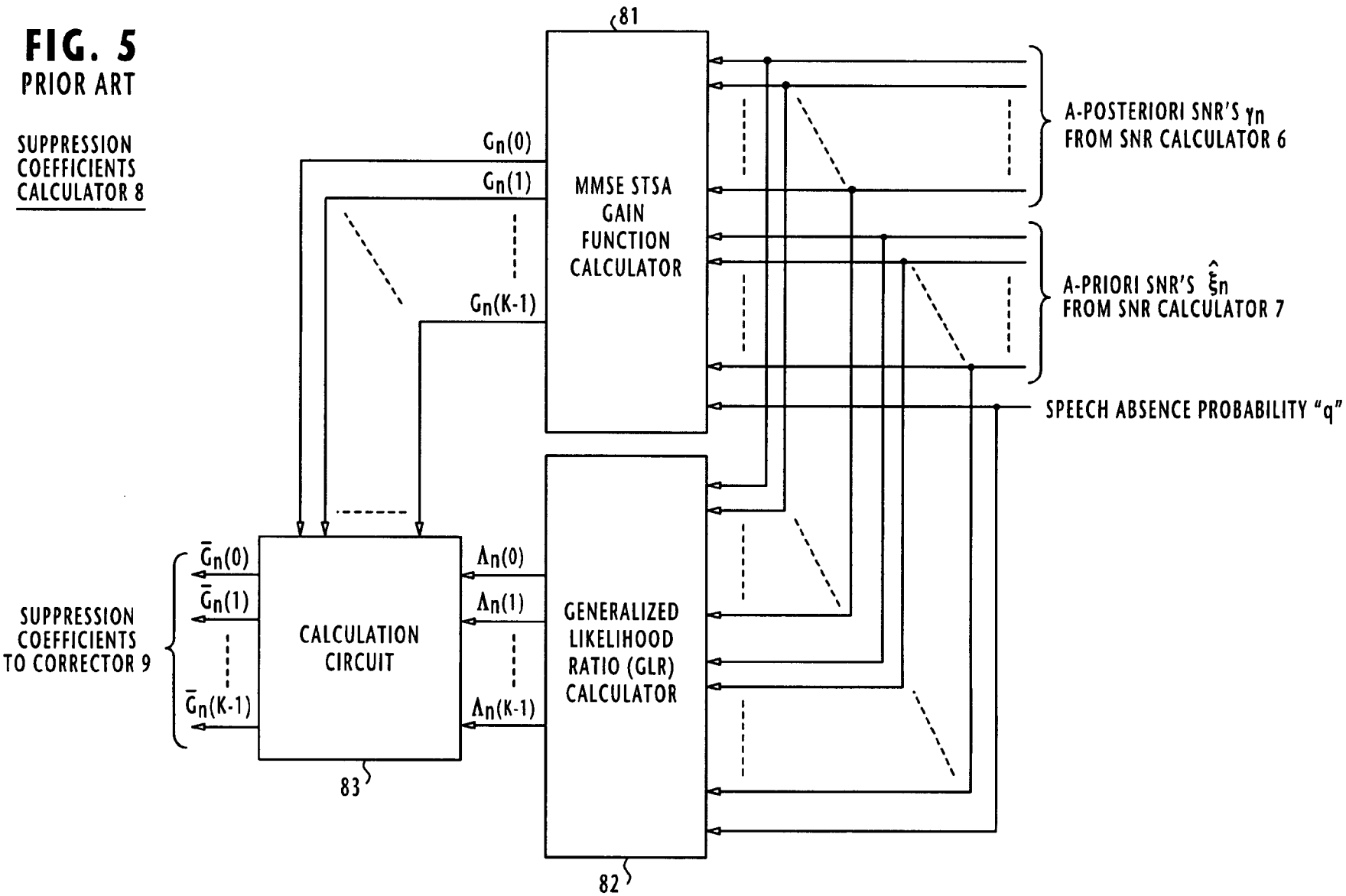
FIG. 5 PRIOR ART
FIG. 5 is a block diagram of the prior art noise suppression coefficients calculator of FIG. 1.
Figure 6:
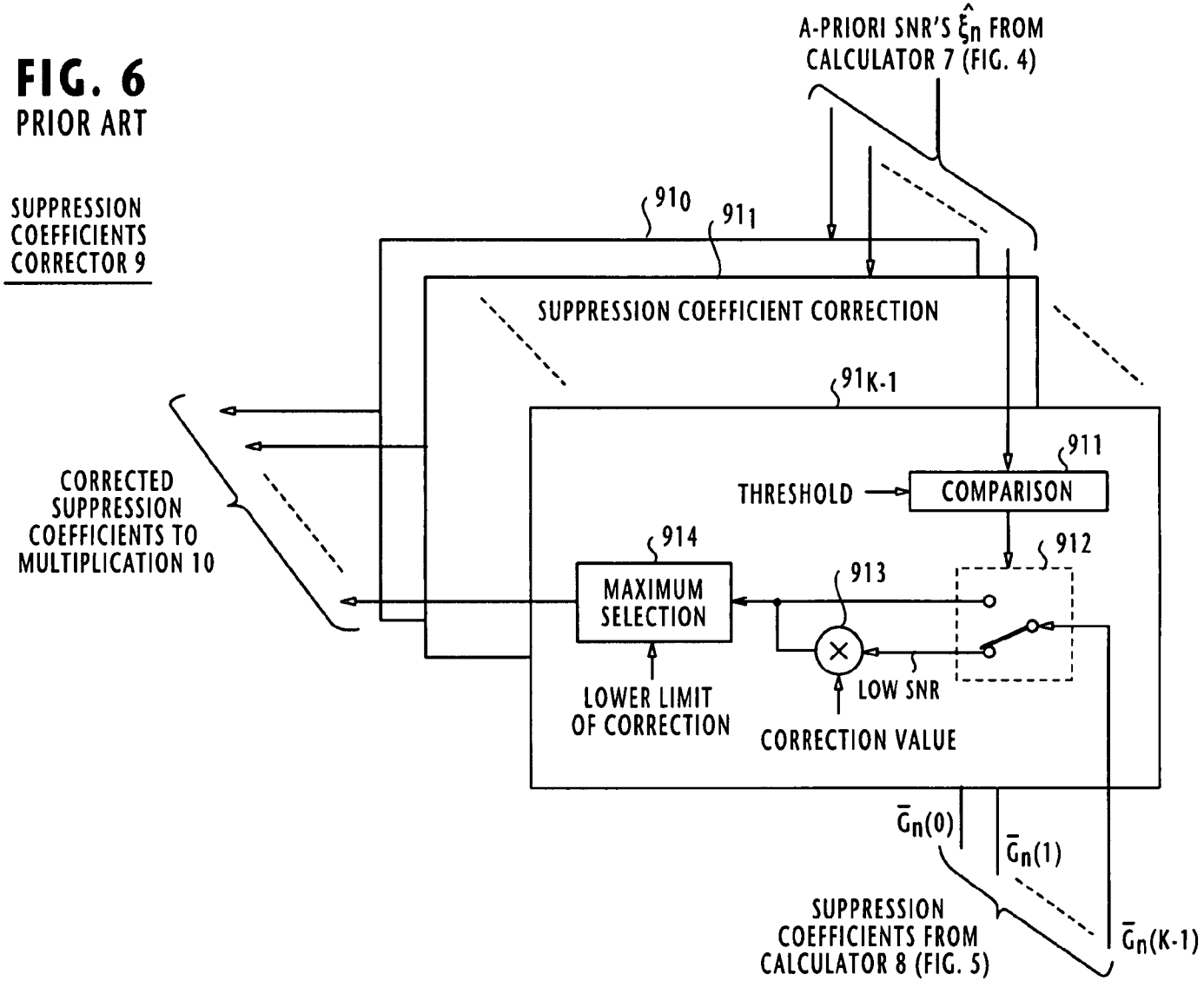
FIG. 6 PRIOR ART
FIG. 6 is a block diagram of the prior art noise suppression coefficients corrector of FIG. 1.
Figure 20:
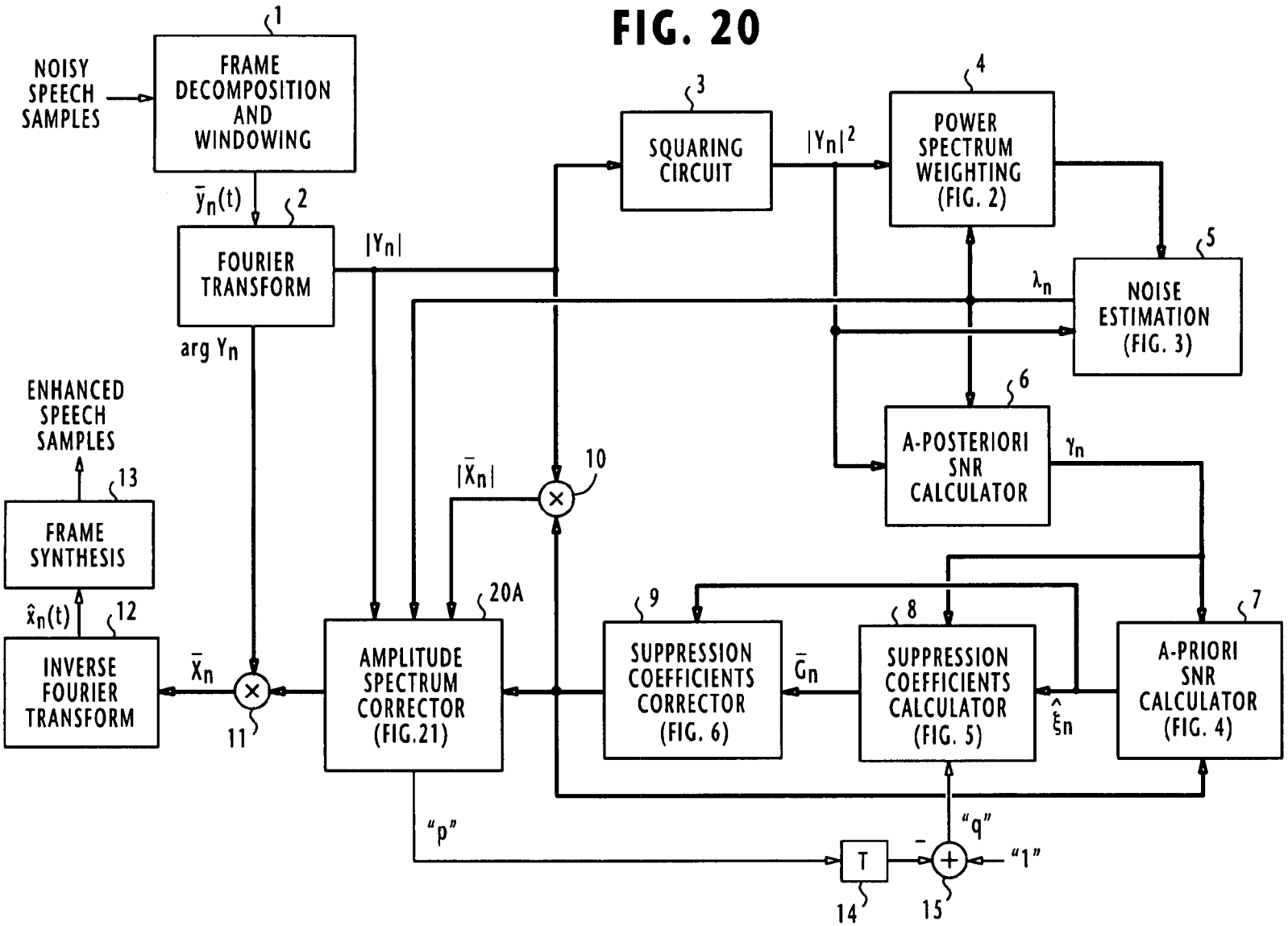
FIG. 20 is a block diagram of a further modification of the first embodiment of the present invention.
Figure 21:
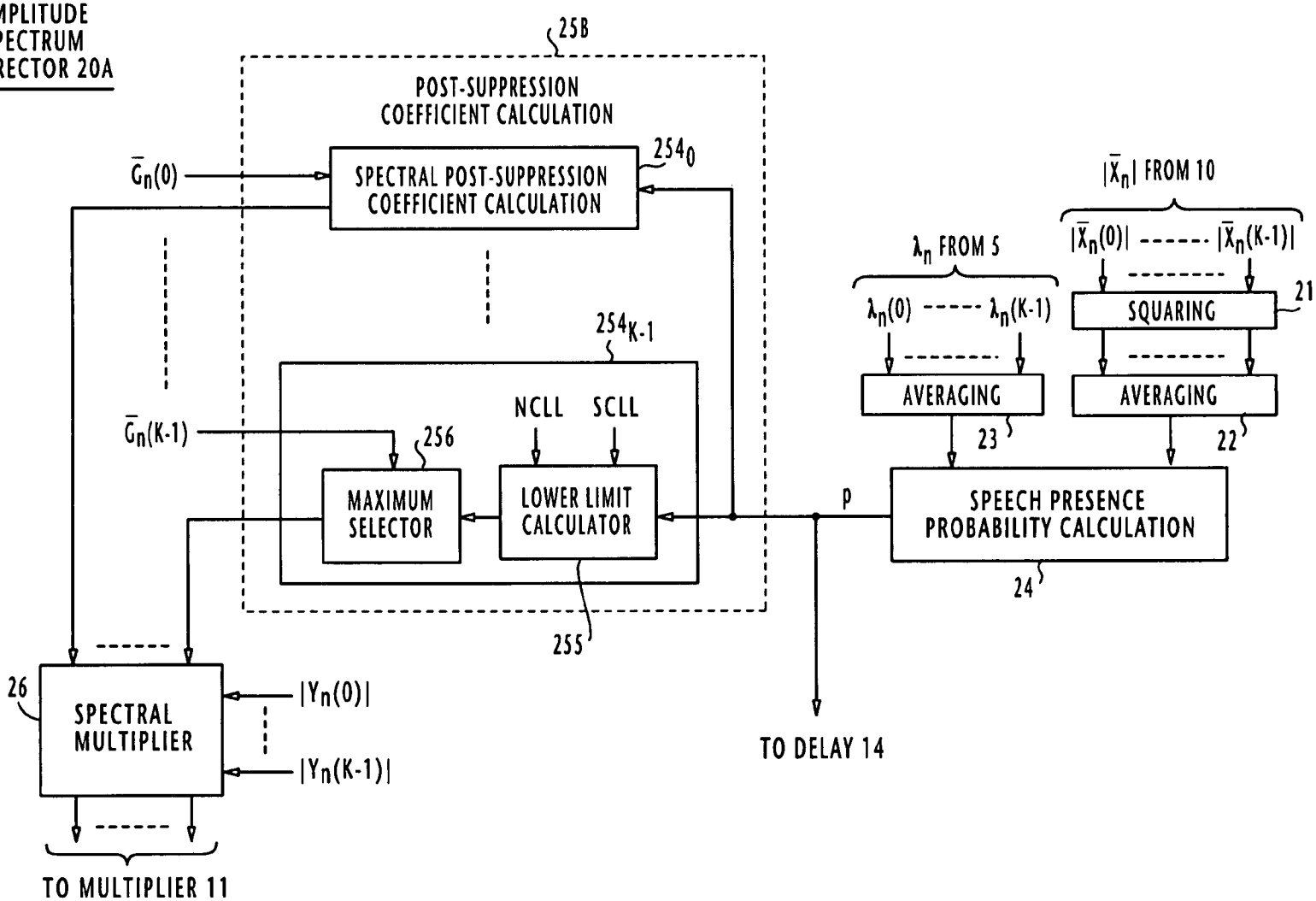
FIG. 21 is a block diagram of the amplitude spectrum corrector of FIG. 20.

FIG. 20 illustrates a further modification of the first embodiment of FIG. 7 in which the amplitude spectrum corrector 20 of FIG. 11 is modified as an amplitude spectrum corrector 20A as shown in FIG. 21 to extract a speech presence probability value "p". The noise suppressor of this embodiment is further provided with a frame-delay element 14 and an adder 15. The probability "p" extracted from the amplitude spectrum corrector 20A is delayed by a frame interval in the delay element 14 and subtracted from "1" to produce a speech absence probability q=1−p, which is supplied to the noise suppression coefficients calculator 8 (FIG. 5).

Figure 22:
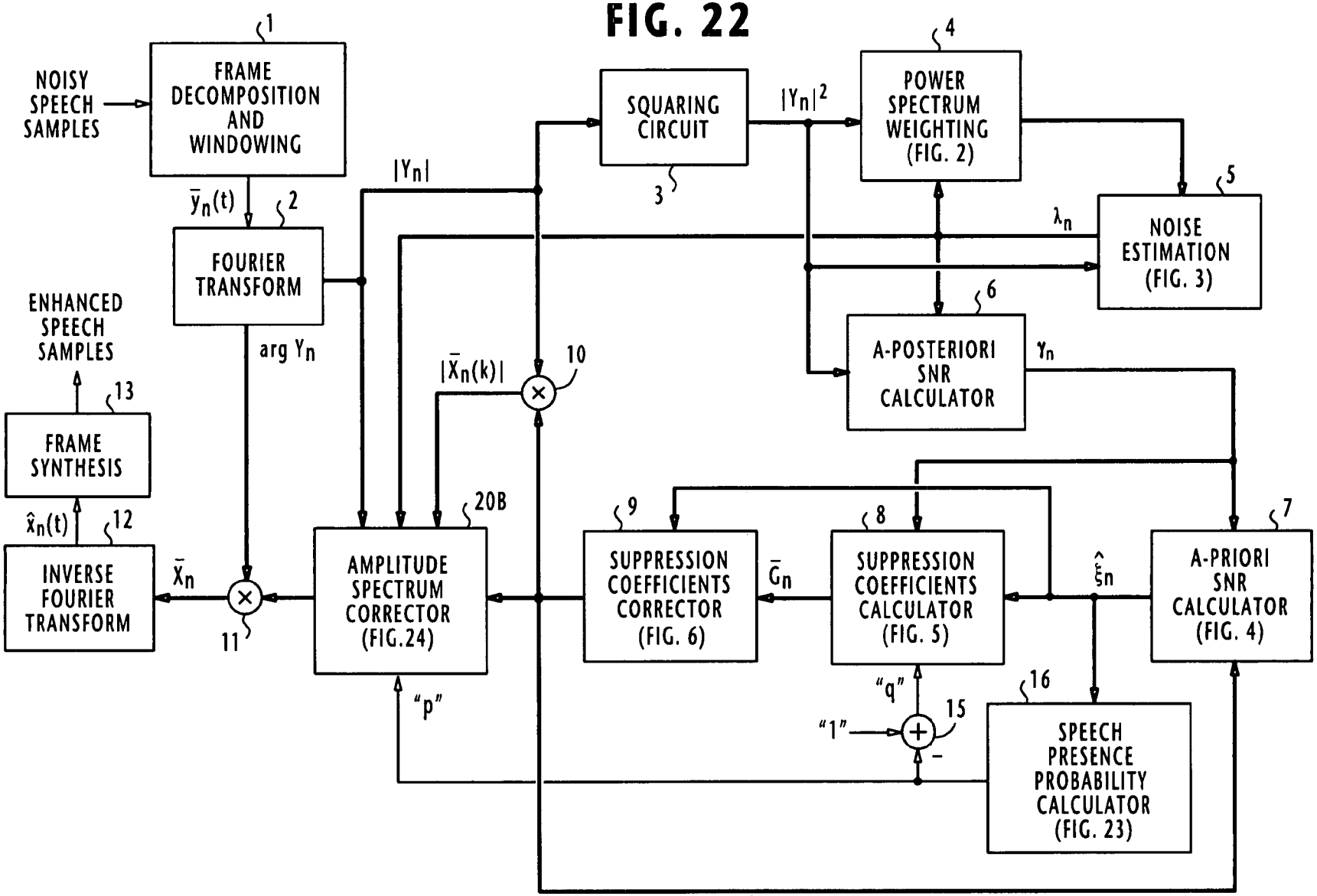
FIG. 22 is a block diagram of a still further modification of the first embodiment of the present invention.

The present invention can be further modified as shown in FIG. 22 in which the speech presence probability "p" is calculated in a speech presence probability calculator 16 from the a-priori SNR values $\hat{\xi}_n$ of calculator 7. The output of speech presence probability calculator 16 is coupled to the amplitude spectrum corrector 20B and the adder 15 where the probability "p" is subtracted from "1" to generate a speech absence probability "q", the latter being supplied to the suppression coefficients calculator 8.

Figure 23:
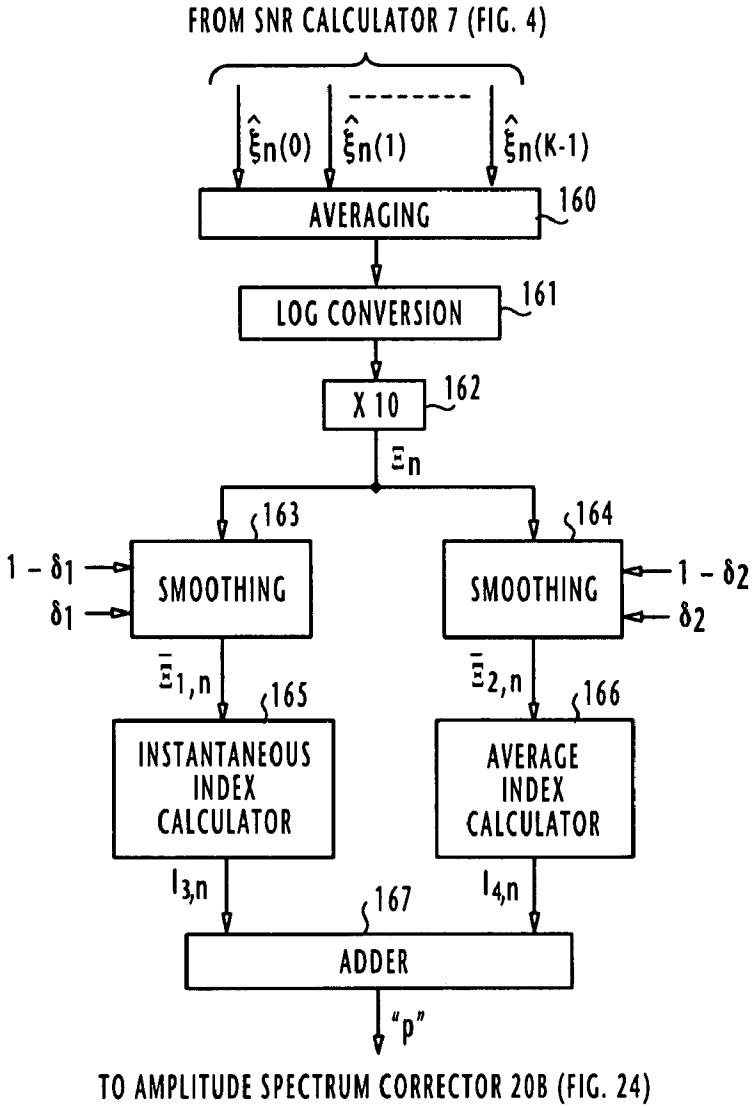
FIG. 23 is a block diagram of the speech presence probability calculator of FIG. 22.

As shown in FIG. 23, the speech presence probability calculator 16 includes an averaging circuit 160 that produces a mean value of the a-priori SNR values $\hat{\xi}_n(0), \ldots, \hat{\xi}_n(K-1)$ by summing them and dividing the sum by integer K. The mean value of the a-priori SNR values is converted to logarithm in a log converter 161 and multiplied by integer "10" in a multiplier 162 to produce a full-band a-priori SNR $\Xi_n$ given below:

$$\Xi_n = 10\log_{10}\left(\frac{1}{K}\sum_{k=0}^{K-1}\hat{\xi}_n(k)\right) \tag{9}$$

The full-band a-priori SNR $\Xi_n$ is smoothed in a pair of smoothing circuits 163 and 164 to produce a pair of first and second smoothed a-priori SNR values $\overline{\Xi}_{1,n}$ and $\overline{\Xi}_{2,n}$ in a manner similar to that described previously with reference to the smoothing circuits 242*a* and 242*b* of FIG. 8 according to Equations (3a) and (3b). The first and second smoothed a-priori SNR values $\overline{\Xi}_{1,n}$ and $\overline{\Xi}_{2,n}$ are respectively supplied to instantaneous index calculator 165 and an average index calculator 166 to produce index signals $I_{3,n}$ and $I_{4,n}$ given below:

$$I_{3,n} = \begin{cases} a_{id\times 2}, & \overline{\Xi}_{1,n} \le \theta_{id\times 2} \\ b_{id\times 2}, & \overline{\Xi}_{1,n} > \theta_{id\times 2} \end{cases} \tag{10a}$$

-continued $$I_{4,n} = \begin{cases} a_{idx2}, & \Xi_{2,n} \le \theta_{idx2} \\ b_{idx2}, & \Xi_{2,n} > \theta_{idx2} \end{cases} \quad (10b)$$

where, $\theta_{idx2}$, $a_{idx2}$, $b_{idx2}$ are real numbers and $a_{idx2}$ is greater than $b_{idx2}$. The index signals vary significantly depending on the values of the smoothed a-priori SNR. The outputs of the index calculators 165 and 166 are summed in an adder 167 to produce an output as the probability "p" of presence of a speech presence. The output "p" of the calculator 16 is supplied to the adder 15 to be subtracted from "1" to generate a speech absence probability "q" for application to the noise suppression coefficients calculator 8 (FIG. 5). Further, the output signal of the speech presence probability calculator 16 is sent to the amplitude spectrum corrector 20B (FIG. 24).

Figure 24:
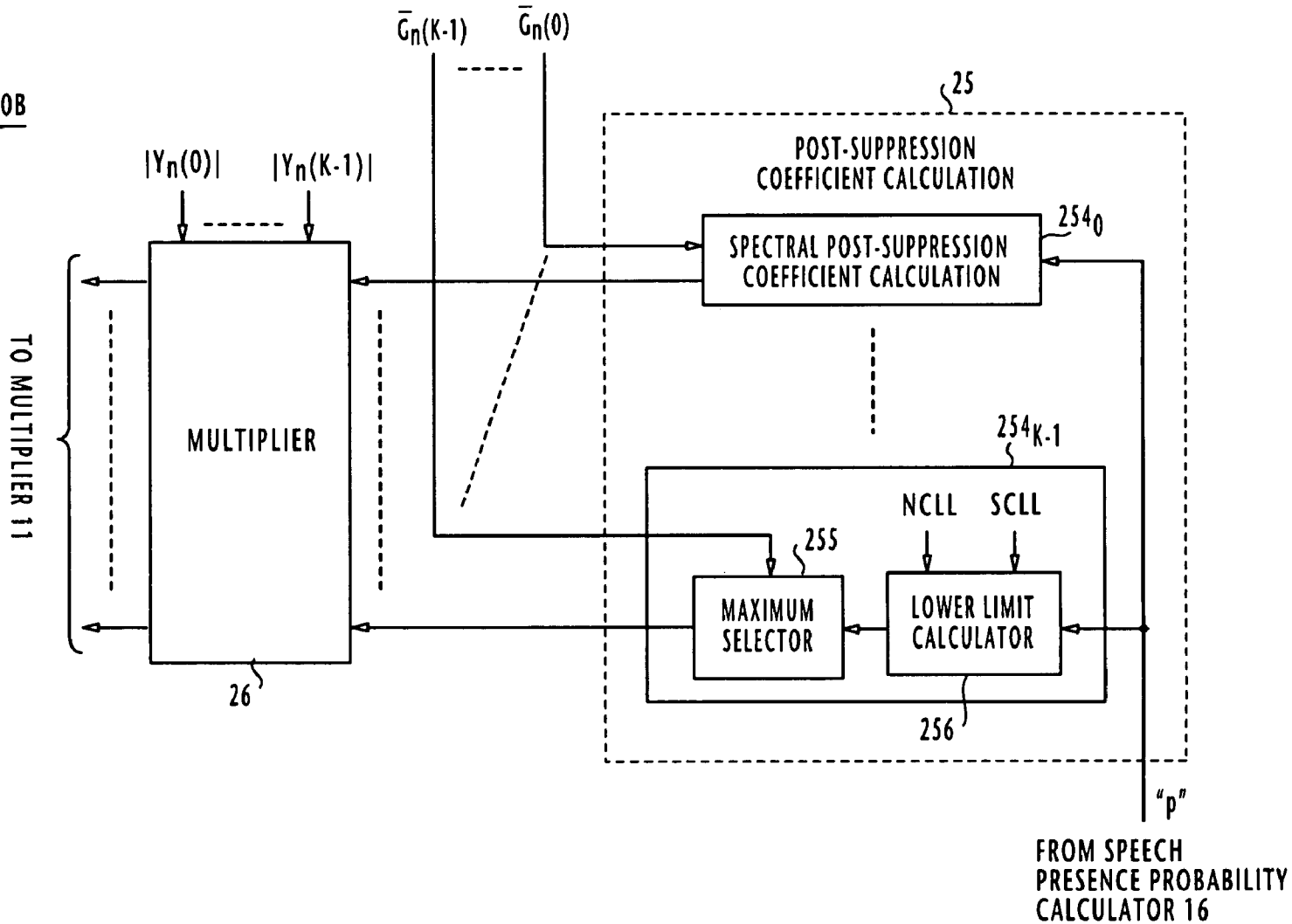
FIG. 24 is a block diagram of the amplitude spectrum corrector of FIG. 23.

As seen in FIG. 24, the amplitude spectrum corrector 20B is similar to the amplitude spectrum corrector 20A of FIG. 21 with the exception that it only includes post-suppression coefficient calculator 25 and multiplier 26. The probability "p" is fed to all the spectral post-suppression coefficient calculators $\mathbf{254}_0$~$\mathbf{254}_{K-1}$.

Figure 25:
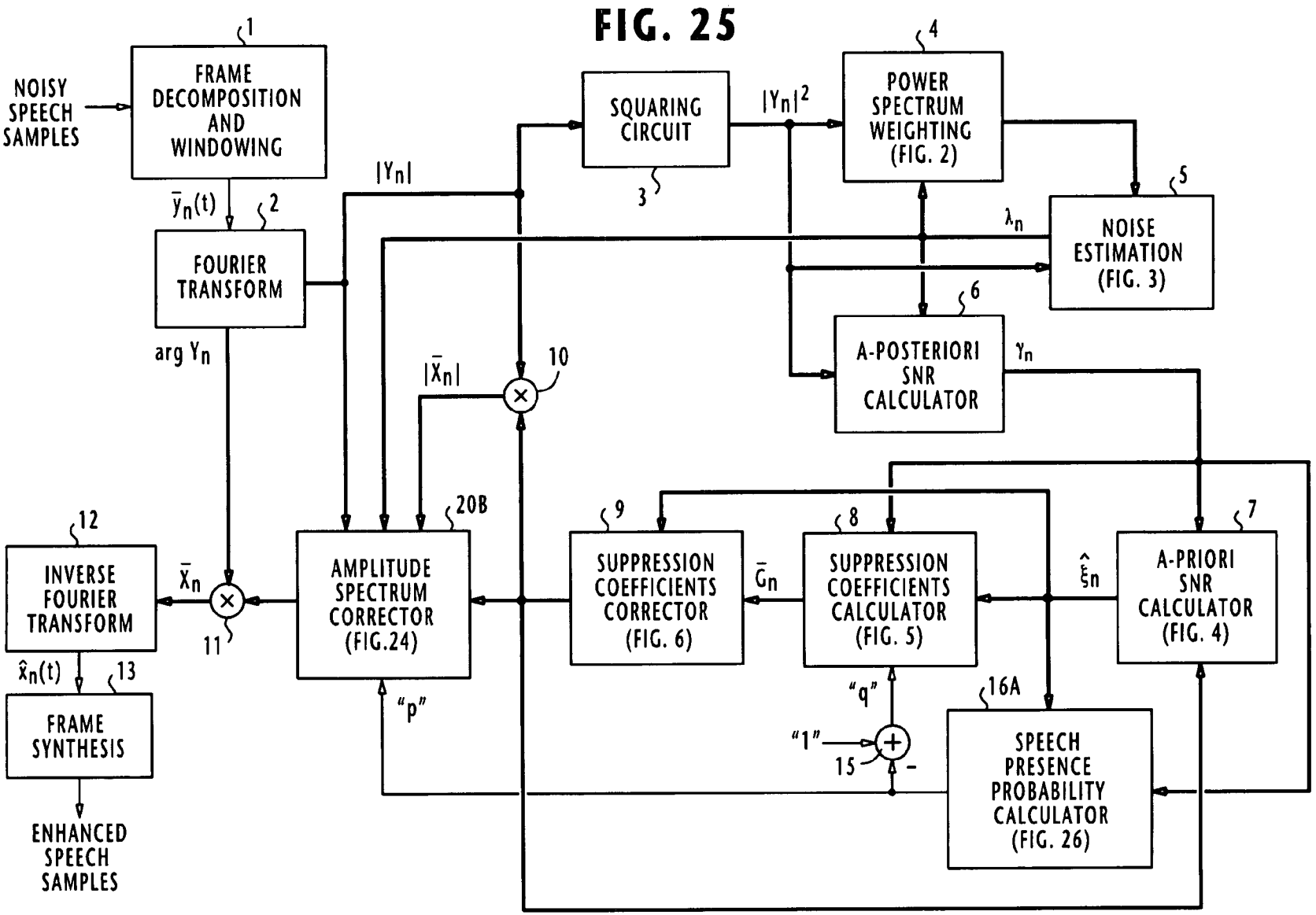
FIG. 25 is a block diagram of a modification of the embodiment of FIG. 22.

The noise suppressor of FIG. 22 can be modified as shown in FIG. 25 in which the a-posteriori SNR values $\gamma_n$ are supplied to a speech presence probability calculator 16A in addition to the a-priori SNR values $\hat{\xi}_n$.

Figure 26:
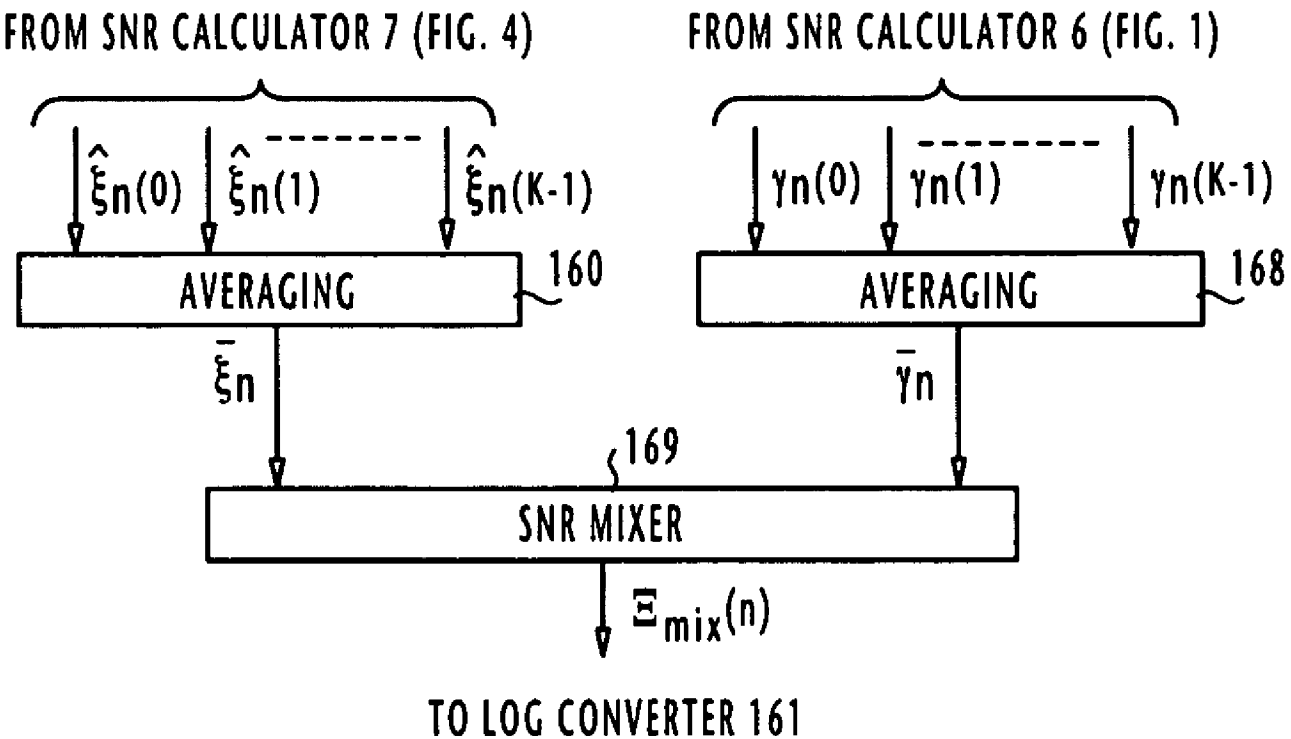
FIG. 26 is a block diagram of the speech presence probability calculator of FIG. 25.

In FIG. 26, the speech presence probability calculator 16A additionally includes an averaging circuit 168 for calculating a mean value of the a-posteriori SNR values $\gamma_n$. The mean value $\bar{\xi}_n$ of the a-priori SNR and the mean value $\bar{\lambda}_n$ of the a-posteriori SNR are combined together in an SNR mixer 169 according to Equation (11) to produce an output $\Xi_{mix}(n)$ as follows:

$$\Xi_{mix}(n)=F_{mix}(\bar{\xi}_n)\bar{\xi}_n+(1-F_{mix}(\bar{\xi}_n))\bar{\gamma}_n \quad (11)$$

where $F_{mix}$ is a function of the a-priori SNR mean value $\bar{\xi}_n$ and assumes a real number in the range between 0 and 1 depending on $\bar{\xi}_n$. The output of the SNR mixer 169 is supplied to the log converter 169.

Equation (11) indicates that, when the input signal is less degraded with noise, the mean value $\bar{\lambda}_n$ of a-posteriori SNR becomes dominant in the output of the SNR mixer 169. Since the degree of precision of the a-posteriori SNR values $\gamma_n$ is higher than that of the a-priori SNR values $\hat{\xi}_n$ when the signal-to-noise ratio of the input signal is high, the output of mixer 169 has a higher degree of precision than the mean value of the a-posteriori SNR values for different values of signal-to-noise ratio. Hence, the speech section probability "p" obtained in this way is more accurate than that of the speech presence probability calculator 16 of FIG. 23.

While mention has been made of embodiments in which a technique known as MMSE-STSA (Minimum Mean Sequence Error Short Time Spectral Amplitude) is used, other techniques such as Wiener filtering and spectral subtraction could equally be as well used.

What is claimed is:

1. A method of suppressing noise in a speech signal by using a computer to carry out the processes of:

a) converting, by at least one processing device, the speech signal to a first vector of frequency spectral speech components and a second vector of frequency spectral speech components identical to said first vector frequency spectral speech components;

b) determining, by the at least one processing device, a vector of noise suppression coefficients based on said first vector frequency spectral speech components;

c) determining, by the at least one processing device, a speech-versus-noise relationship based on said first vector frequency spectral speech components;

d) determining, by the at least one processing device, a vector of post-suppression coefficients based on said determined speech-versus-noise relationship, said first vector frequency spectral speech components, and said vector of noise suppression coefficients determined in process (b); and e) weighting, by the at least one processor, said second vector frequency spectral speech components by said vector of post-suppression coefficients.

2. The method of claim 1, wherein (d) comprises determining a first correction factor based on said first vector frequency spectral speech components, and calculating said vector of post-suppression coefficients based on the first correction factor and a predetermined second correction factor, combining the first and second correction factors to produce a combined correction factor and weighting said vector of noise suppression coefficients by said combined correction factor to determine said vector of post-suppression coefficients.

3. The method of claim 2, wherein (d) comprises weighting said first vector frequency spectral speech components with said noise suppression coefficients to produce a vector of enhanced speech amplitude spectral components and using the vector of enhanced speech amplitude spectral components for determining said first correction factor.

4. The method of claim 2, further comprising estimating a vector of frequency spectral noise components from said first vector frequency spectral speech components and wherein (d) comprises using the vector of the estimated frequency spectral noise components for determining said first correction factor.

5. The method of claim 4, wherein (c) comprises:

squaring said frequency spectral speech components;

averaging said squared frequency spectral speech components to produce a speech power mean value;

averaging the estimated frequency spectral noise components to produce a noise power mean value smoothing the speech power mean value according to first and second smoothing factors to produce a first smoothed speech power mean value and a second smoothed speech power mean value;

producing a first function value and a second function value from said noise power mean value;

producing a first index from said first function value according to said first smoothed speech power mean value and a second index from said second function value according to said second smoothed speech power mean value; and summing said first and second indices to produce an output signal representing said speech-versus-noise relationship.

6. The method of claim 2, wherein (d) comprises determining said second correction factor based on said first vector frequency spectral speech components and using the first and second correction factors to determine said vector of post-suppression coefficients.

7. The method of claim 2, wherein (d) comprises combining said first and second correction factors according to said determined speech-versus-noise relationship to produce said combined correction factor.

8. The method of claim 7, wherein (d) comprises combining said first correction factor and said second correction factor according to $pF_V+(1-p)F_U$, where p represents said speech-versus-noise relationship and $F_U$ and $F_V$ represent said first correction factor and said second-correction factor, respectively.

9. The method of claim 1, wherein said speech-versus-noise relationship represents a probability of presence of a speech section in said first vector frequency spectral speech components.

10. The method of claim 1, wherein (d) comprises determining a plurality of lower limit values of noise suppression coeficients based on said speech-versus-noise relationship, comparing said vector of noise suppression coefficients with said lower limit values of noise suppression coefficients, and determining said vector of post-suppression coefficients by using said plurality of lower limit values or said noise suppression coefficients depending on a result of the comparison.

11. The method of claim 10, wherein (d) comprises determining said plurality of lower limit values of noise suppression coefficients further based on a first correction factor lower limit value and a second correction factor lower limit value.

12. The method of claim 11, wherein (d) comprises determining said first correction factor lower limit value and said second correction factor lower limit value based on said speech-versus-noise relationship.

13. The method of claim 1, further comprising:

estimating a vector of frequency spectral noise components from said first vector frequency spectral speech components, and determining a vector of enhanced speech amplitude spectral components by using said first vector of frequency spectral speech components and said vector of noise suppression coefficients, wherein (c) comprises determining said speech-versus-noise relationship based on said estimated vector of frequency spectral noise components and said vector of enhanced speech amplitude spectral components.

14. The method of claim 1, wherein (d) comprises determining said vector of post-suppression coefficients such that noise suppression is low when said speech-versus-noise relationship indicates a high probability of presence of a speech section in said first vector frequency spectral speech components.

15. An apparatus for suppressing noise in a speech signal, comprising:

a converter that converts the speech signal to a first vector of frequency spectral speech components and a second vector of frequency spectral speech components identical to said first vector of frequency spectral speech components;

a noise suppression coefficient calculator that determines a vector of noise suppression coefficients based on said first vector frequency spectral speech components;

a speech-versus-noise relationship calculator that determines a speech-versus-noise relationship based on said first vector frequency spectral speech components and said vector of noise suppression coefficients;

a post-suppression coefficient calculator that determines a vector of post-suppression coefficients based on said speech-versus-noise relationship, said first vector frequency spectral speech components, and said vector of noise suppression coefficients determined by said noise suppression coefficient calculator; and a weighting circuit that weights said second vector of frequency spectral speech components by said vector of post-suppression coefficients.

16. The apparatus of claim 15, wherein said post-suppression coefficient calculator determines a first correction factor based on said first vector frequency spectral speech components and calculates said post-suppression coefficient based on the first correction factor and a predetermined second correction factor, combines the first and second correction factors to produce a combined correction factor and weights said vector of noise suppression coefficients with said combined correction factor to determine said vector of post-suppression coefficients.

17. The apparatus of claim 16, further comprising a weighting circuit that weights said first vector frequency spectral speech components with said vector of noise suppression coefficients from said noise suppression coefficient calculator to produce a vector of enhanced speech amplitude spectral components and wherein said post-suppression coefficient calculator uses the vector of enhanced speech amplitude spectral components to determine said first correction factor.

18. The apparatus of claim 16, further comprising a noise estimation circuit that estimates a vector of frequency spectral noise components from said first vector of frequency spectral speech components, and wherein said post-suppression coefficient calculator uses the estimated frequency spectral noise components to determine said first correction factor.

19. The apparatus of claim 18, further comprising a squaring circuit that squares said first vector frequency spectral speech components, a first averaging circuit that averages said squared frequency spectral speech components to produce a speech power mean value and a second averaging circuit that averages the estimated frequency spectral noise components to produce a noise power mean value, and wherein speech-versus-noise relationship calculator comprises:

smoothing circuits that smooth the speech power mean value according to first and second smoothing factors respectively to produce a first smoothed speech power mean value and a second smoothed speech power mean value;

first and second function value calculators that produce a first function value and a second function value from said noise power mean value;

first and second index calculators that produce a first index from said first function value according to said first smoothed speech power mean value and a second index from said second function value according to said second smoothed speech power mean value; and an adder that sums said first and second indices to produce an output signal representing said speech-versus-noise relationship.

20. The apparatus of claim 16, wherein said post-suppression coefficient calculator determines said second correction factor based on said first vector of frequency spectral speech components and uses the first and second correction factors to determine said vector of post-suppression coefficients.

21. The apparatus of claim 16, wherein said post-suppression coefficient calculator comprises a combining circuit that combines said first and second correction factors according to said determined speech-versus-noise relationship.

22. The apparatus of claim 21, wherein said combining circuit said first correction factor and said second correction factor according to $pF_V+(1-p)F_U$, where p represents said speech-versus-noise relationship and $F_U$ and $F_V$ represent said first correction factor and said second-correction factor, respectively.

23. The apparatus of claim 15, wherein said speech-versus-noise relationship represents a probability of presence of a speech section in said first vector of frequency spectral speech components.

24. The apparatus of claim 15, wherein said post-suppression coefficient calculator determines a plurality of lower limit values of noise suppression coefficients based on said speech-versus-noise relationship, compares said vector of noise suppression coefficients with said lower limit values of noise suppression coefficients, and determines said vector of post-suppression coefficients by using said plurality of lower limit values or said noise suppression coefficients depending on a result of the comparison.

25. The apparatus of claim 24, wherein said post-suppression coefficient calculator determines said plurality of lower limit values of noise suppression coefficients further based on a first correction factor lower limit value and a second correction factor lower limit value.

26. The apparatus of claim 25, wherein said post-suppression coefficient calculator determines said first correction factor lower limit value and said second correction factor lower limit value based on said speech-versus-noise relationship.

27. The apparatus of claim 15, further comprising:

means for estimating a vector of frequency spectral noise components from said first vector frequency spectral speech components; and means for determining a vector of enhanced speech amplitude spectral components by using said first vector of frequency spectral speech components and said vector of noise suppression coefficients, wherein said speech versus noise relationship calculator comprises means for determining said speech-versus-noise relationship based on said estimated vector of frequency spectral noise components and said vector of enhanced speech amplitude spectral components.

28. The apparatus of claim 15, wherein said post-suppression coefficient calculator comprises means for determining said vector of post-suppression coefficients such that noise suppression is low when said speech-versus-noise relationship indicates a high probability of presence of a speech section in said first vector frequency spectral speech components.

29. An apparatus for suppressing noise in a speech signal, comprising:

a converter that converts the speech signal to a first vector of frequency spectral speech components and a second vector of frequency spectral speech components identical to said first vector of frequency spectral speech components;

a noise estimator estimates a vector of frequency spectral noise components from said first vector frequency spectral speech components;

a signal-to-noise ratio calculator that calculates a signal-to-noise ratio by using at least said first vector of frequency spectral speech components and said estimated vector of frequency spectral noise components;

a noise suppression coefficient calculator that determines a vector of noise suppression coefficients from said signal-to-noise ratio;

a suppression coefficient corrector that corrects said vector of noise suppression coefficients by using said signal-to-noise ratio; and a weighting circuit that weights said second vector of frequency spectral speech components by said vector of corrected noise suppression coefficients.

30. The apparatus of claim 29, wherein said signal-to-noise calculator comprises a speech-versus-noise relationship calculator that determines a speech-versus-noise relationship from said vector of estimated frequency spectral noise components, said vector of noise suppression coefficients and said first vector of frequency spectral speech components, and wherein said suppression coefficient corrector determines a vector of lower limit values of said noise suppression coefficients based on said speech-versus-noise relationship and selects a greater one of said vector of lower limit values and said vector of noise suppression coefficients as said corrected noise suppression coefficients.

31. The apparatus of claim 29, wherein said speech-versus-noise relationship represents a probability of presence of a speech section in said first vector of frequency spectral speech components.

32. The apparatus of claim 29, wherein said signal-to-noise ratio calculator determines a vector of speech power estimates from said first vector of frequency spectral speech components, said estimated vector of frequency spectral noise components and said vector of noise suppression coefficients, and wherein said suppression coefficient corrector calculates a vector of first section correction factors by using said vector of estimated frequency spectral noise components and said a vector of speech power estimates and said a vector of speech power estimates, combines the vector of the first section correction factors with a vector of second section correction factors to product a vector of combined correction factors, and corrects said vector of noise suppression coefficients with said vector of combined correction factors.

33. The apparatus of claim 32, wherein said suppression coefficient corrector combines said vector of first correction factors and said vector of second correction factors according to $pF_V+(1-p)F_U$, where p represents said speech-versus-noise relationship and $F_U$ and $F_V$ represent said first and second correction factors, respectively.

* * * * *